US008606567B2

(12) United States Patent
Maeda et al.

(10) Patent No.: US 8,606,567 B2
(45) Date of Patent: Dec. 10, 2013

(54) SIGNAL ENCODING APPARATUS, SIGNAL DECODING APPARATUS, SIGNAL PROCESSING SYSTEM, SIGNAL ENCODING PROCESS METHOD, SIGNAL DECODING PROCESS METHOD, AND PROGRAM

(75) Inventors: Yuuji Maeda, Tokyo (JP); Jun Matsumoto, Kanagawa (JP); Yasuhiro Toguri, Kanagawa (JP); Shiro Suzuki, Kanagawa (JP); Yuuki Matsumura, Saitama (JP)

(73) Assignee: Sony Corporation, Tokyo (JP)

( * ) Notice: Subject to any disclaimer, the term of this patent is extended or adjusted under 35 U.S.C. 154(b) by 792 days.

(21) Appl. No.: 12/832,476

(22) Filed: Jul. 8, 2010

(65) Prior Publication Data

US 2011/0015933 A1 Jan. 20, 2011

(30) Foreign Application Priority Data

Jul. 17, 2009 (JP) ..... P2009-168465

(51) Int. Cl.
*G10L 19/02* (2013.01)
*G10L 11/00* (2006.01)

(52) U.S. Cl.
USPC ..... 704/206; 704/205

(58) Field of Classification Search
None
See application file for complete search history.

(56) References Cited

U.S. PATENT DOCUMENTS 5,737,718 A 4/1998 Tsutsui
6,061,649 A * 5/2000 Oikawa et al. ..... 704/226

FOREIGN PATENT DOCUMENTS

JP 3277692 2/2002

* cited by examiner

*Primary Examiner* — Talivaldis Ivars Smits
(74) *Attorney, Agent, or Firm* — Finnegan, Henderson, Farabow, Garrett & Dunner, L.L.P.

(57) ABSTRACT

Provided is a signal encoding apparatus including: an encoding unit which encodes a quantization value of a frequency spectrum in an input signal through a plurality of encoding algorithms; an amplitude change amount calculation unit which calculates, for each of a plurality of subbands of the frequency spectrum, an amplitude change amount with respect to the frequency spectrum based on a spectrum envelope of the frequency spectrum; and an encoding selection unit which selects, for each subband, the encoding algorithm according to a degree of deflection of an occurrence probability distribution of the quantization value in the amplitude change amount among the plurality of the encoding algorithms.

11 Claims, 22 Drawing Sheets

FIG. 14

121 122 123

| SOUND SOURCE | COMPRESSION RATIO [%] | | COMPRESSION RATIO DIFFERENCE [%] |
|---|---|---|---|
| | SYSTEM IN THE RELATED ART | ACOUSTIC SIGNAL PROCESSING SYSTEM 100 | |
| GENERAL MUSIC PIECE 1 | 79.2 | 77.9 | −1.3 |
| GENERAL MUSIC PIECE 2 | 80.5 | 79.7 | −0.8 |
| KEYBOARD INSTRUMENT 1 | 77.5 | 75.4 | −2.1 |
| KEYBOARD INSTRUMENT 2 | 78.2 | 76.6 | −1.6 |
| PERCUSSION INSTRUMENT 1 | 74.1 | 70.4 | −3.7 |
| PERCUSSION INSTRUMENT 2 | 77.2 | 75.2 | −2.0 |
| WIND INSTRUMENT 1 | 77.6 | 75.7 | −2.1 |
| WIND INSTRUMENT 2 | 72.2 | 67.6 | −4.6 |
| CLASSICAL MUSIC PIECE | 77.4 | 75.2 | −2.2 |

SIGNAL ENCODING APPARATUS, SIGNAL DECODING APPARATUS, SIGNAL PROCESSING SYSTEM, SIGNAL ENCODING PROCESS METHOD, SIGNAL DECODING PROCESS METHOD, AND PROGRAM

BACKGROUND OF THE INVENTION

1. Field of the Invention

The present invention relates to a signal encoding apparatus, a signal decoding apparatus, and a signal processing system, and more particularly, to a signal encoding apparatus for encoding frequency components generated based on an input signal, a method of processing the same, and a program for allowing a computer to execute the method.

2. Description of the Related Art

In general, in an acoustic signal encoding apparatus which encodes an acoustic signal in the related art, the acoustic signal is converted into frequency components which are normalized and quantized, and the normalized quantization value is encoded. For example, a system which divides the frequency component in the acoustic signal in each predetermined band and quantizes the signal divided in each predetermined band is disclosed (refer to FIG. 1 of Japanese Patent No. 3277692).

In the aforementioned technology of the related art, the frequency components of the acoustic signal are quantized in each of predetermined subbands, so that quantization accuracy can be controlled with respect to each subband. Therefore, the quantization can be performed by using characteristics of human auditory perception such as a masking effect. However, in the case where the quantization is performed with respect to each subband, since the occurrence probability distribution of the quantization value is different among the subbands, the encoding efficiency greatly decreases in some occurrence probability distribution of the quantization value. Therefore, the compression rate of the acoustic signal may deteriorate.

SUMMARY OF THE INVENTION

It is desirable to improve a compression rate through encoding of an input signal.

In a first embodiment of the invention, there are provided a signal encoding apparatus including: an encoding unit which encodes a quantization value of a frequency spectrum in an input signal through a plurality of encoding algorithms; an amplitude change amount calculation unit which calculates an amplitude change amount with respect to the frequency spectrum based on a spectrum envelope of the frequency spectrum; and an encoding selection unit which selects the encoding algorithm according to a degree of deflection of an occurrence probability distribution of the quantization value in the amplitude change amount among the plurality of the encoding algorithms, a signal encoding method, and a program for allowing a computer to execute the signal encoding method. Accordingly, it is possible to obtain a function of selecting the encoding algorithm according to the degree of deflection of the occurrence probability distribution of the quantization value based on the amplitude change amount in the spectrum envelope of the frequency spectrum in the input signal, among the plurality of the encoding algorithm for encoding the quantization value.

In addition, in the first embodiment, the signal encoding apparatus may further include an amplitude reference value generation unit which generates the amplitude reference value with respect to the subband as the spectrum envelope based on a maximum level of the frequency spectrum extracted in each of the subbands in the frequency band of the frequency spectrum, wherein the amplitude change amount calculation unit calculates the amplitude change amount in each subband based on the amplitude reference value with respect to a change amount calculation band that is a predetermined subband among the plurality of the subbands, and wherein, in the case where the amplitude change amount with respect to the subband is large, the encoding selection unit selects the encoding algorithm for encoding the quantization value corresponding to the subband, where the degree of deflection is large, in each subband. Accordingly, in the case where the amplitude change amount is calculated based on the amplitude reference value with respect to the change amount calculation band in the vicinity of the plurality of subbands, where the amplitude change amount is to be calculated, among the amplitude reference values generated based on the maximum level of the frequency spectrum in each of the subbands, and the amplitude change amount is large, it is possible to obtain a function of selecting the encoding algorithm for encoding the quantization value corresponding to the subband, where the degree of deflection of the occurrence probability distribution is large, in each subband. In this case, the amplitude change amount calculation unit may calculate the amplitude change amount in each subband based on a difference in the amplitude reference value with respect to the adjacent subband that is the change amount calculation band. Accordingly, it is possible to obtain a function of allowing the amplitude change amount calculation unit to calculate the amplitude change amount with respect to the frequency spectrum in each subband based on the difference in the amplitude reference value with respect to the adjacent subband that is a low or high band.

In addition, in the case where the signal encoding apparatus further includes an amplitude reference value generation unit which generates the amplitude reference value with respect to the subband as the spectrum envelope based on a maximum level of the frequency spectrum extracted in each of the subbands in the frequency band of the frequency spectrum, wherein the amplitude change amount calculation unit calculates the amplitude change amount in each subband based on the amplitude reference value with respect to a change amount calculation band that is a predetermined subband among the plurality of the subbands, and wherein, in the case where the amplitude change amount with respect to the subband is large, the encoding selection unit selects the encoding algorithm for encoding the quantization value corresponding to the subband, where the degree of deflection is large, in each subband, the amplitude change amount calculation unit may calculate the amplitude change amount in each subband based on an average value of the amplitude reference values with respect to the subbands in a low band and the amplitude reference value with respect to the change amount calculation band. Accordingly, it is possible to obtain a function of calculating the amplitude change amount with respect to the subband based on the average value of the amplitude reference value with respect to the subbands in a low band and the amplitude reference value with respect to the subband where the amplitude change amount is to be calculated.

In addition, in the case where the signal encoding apparatus further includes an amplitude reference value generation unit which generates the amplitude reference value with respect to the subband as the spectrum envelope based on a maximum level of the frequency spectrum extracted in each of the subbands in the frequency band of the frequency spectrum, wherein the amplitude change amount calculation unit calculates the amplitude change amount in each subband based on the amplitude reference value with respect to a change amount calculation band that is a predetermined subband among the plurality of the subbands, and wherein, in the case where the amplitude change amount with respect to the subband is large, the encoding selection unit selects the encoding algorithm for encoding the quantization value corresponding to the subband, where the degree of deflection is large, in each subband, the amplitude reference value generation unit may generate a scale factor, which is a reference of an amplitude level of the subband, as the amplitude reference value. Accordingly, it is possible to obtain a function of allowing the amplitude reference value generation unit to generate the scale factor, which is the amplitude level for the normalization of the frequency spectrum in the subband, as the amplitude reference value.

In a second embodiment of the invention, there is provided a signal decoding apparatus including: a decoding unit which decodes an encoding data, where a quantization value of a frequency spectrum in an input signal is encoded, through a plurality of decoding algorithms; an amplitude change amount calculation unit which calculates an amplitude change amount with respect to the subband from an amplitude reference value of a predetermined subband among the amplitude reference values generated based on the frequency spectrum extracted in each of the subbands in a frequency band of the frequency spectrum; and a decoding selection unit which selects the decoding algorithm according to a degree of deflection of an occurrence probability distribution of the quantization value in the amplitude change amount among the plurality of the decoding algorithms, a signal decoding process method, and a program for allowing a computer to execute the signal decoding process method. Accordingly, it is possible to obtain a function of selecting the decoding algorithm according to the degree of deflection of the occurrence probability distribution of the quantization value in the amplitude change amount calculated based on the amplitude reference value input from the signal encoding apparatus, among the plurality of the decoding algorithms for decoding the encoding data.

In a third embodiment of the invention, there is provided a signal processing system including: a signal encoding apparatus having an encoding unit which encodes a quantization value of a frequency spectrum in an input signal through a plurality of encoding algorithms, an amplitude reference value generation unit which generates an amplitude reference value with respect to a subband based on the frequency spectrum extracted in each of the subbands in the frequency spectrum, an amplitude change amount calculation unit which calculates an amplitude change amount in each subband based on the amplitude reference value with respect to a change amount calculation band which is a predetermined subband among the plurality of the subbands, and an encoding selection unit which selects the encoding algorithm according to a degree of deflection in an occurrence probability distribution of the quantization value in the amplitude change amount among the plurality of the encoding algorithms; and a signal decoding apparatus having a decoding unit which decodes a data, where the quantization value of the frequency spectrum in the input signal is encoded, through a plurality of decoding algorithms, an amplitude change amount calculation unit which calculates the amplitude change amount in each subband based on the amplitude reference value with respect to the change amount calculation band among the amplitude reference values generated by the amplitude reference value encoding unit in the signal encoding apparatus, and a decoding selection unit which selects the decoding algorithm according to the degree of deflection of the occurrence probability distribution of the quantization value in the amplitude change amount among the plurality of the decoding algorithms. Accordingly, it is possible to obtain a function of allowing the signal encoding apparatus to select the encoding algorithm according to the degree of deflection of the occurrence probability distribution of the quantization value in the amplitude change amount generated based on the amplitude reference value of the change amount calculation band in the plurality of the subbands, among the encoding algorithms for encoding the quantization value, and of allowing the signal decoding apparatus to select the decoding algorithm according to the degree of deflection of the occurrence probability distribution of the quantization value, among the plurality of the decoding algorithms for decoding the encoding data encoded based on the amplitude change amount by using the amplitude reference value of the change amount calculation band, which is defined in the same manner as the signal encoding apparatus, among the amplitude reference values in each subband input from the signal encoding apparatus.

According to the invention, there is an advantage in that it is possible to improve a compression rate by encoding an input signal.

BRIEF DESCRIPTION OF THE DRAWINGS

FIG. 14 is a diagram illustrating a result of comparison of a compression rate in the acoustic signal processing system and a compression rate of a system of the related art.

DESCRIPTION OF THE PREFERRED EMBODIMENTS

Hereinafter, exemplary embodiments (hereinafter, referred to as embodiments) according to the invention will be described. The description is made in the following order.

1. First Embodiment (Encoding Process: Modified Example of Encoding Algorithm Based on Amplitude Reference Value of Adjacent Subband)
2. Second Embodiment (Decoding Process: Modified Example of Decoding Algorithm Based on Amplitude Reference Value Input from Acoustic Decoding Apparatus)
3. Third Embodiment (Encoding Process: Modified Example of Encoding Algorithm Based on Average Value of Frequency Spectrum and Amplitude Reference Value of Subband)
4. Fourth Embodiment (Decoding Process: Modified Example of Decoding Algorithm Based on Average Value of Frequency Spectrum and Amplitude Reference Value of Subband)
5. Fifth Embodiment (Encoding Process: Modified Example of Arithmetic Encoding Algorithm or Huffman Encoding Algorithm Based on Amplitude Change Amount)

1. First Embodiment

[Example of Configuration of Acoustic Signal Processing System]

Figure 1:
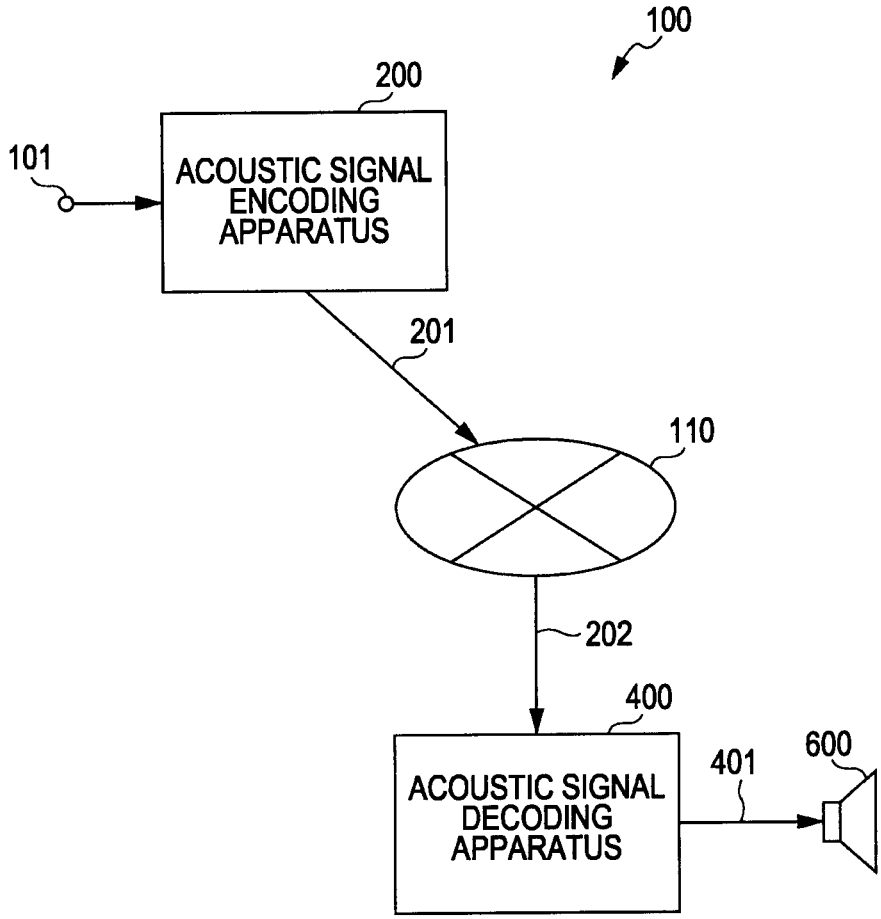
FIG. 1 is a block diagram illustrating an example of a configuration of an acoustic signal processing system according town embodiment of the invention.

FIG. 1 is a block diagram illustrating an example of a configuration of an acoustic signal processing system according to an embodiment of the invention. The acoustic signal processing system 100 includes an acoustic signal encoding apparatus 200 which encodes an acoustic signal input from an acoustic signal input terminal 101 and an acoustic signal decoding apparatus 400 which decodes the encoded acoustic signal and outputs the decoded acoustic signal to a speaker 600 through an acoustic signal output line 401. In this embodiment, it is considered that the acoustic signal encoded by the acoustic signal encoding apparatus 200 is transmitted via a network 110 to the acoustic signal decoding apparatus 400.

The acoustic signal encoding apparatus 200 converts the acoustic signal that is an input signal input from the acoustic signal input terminal 101 into a frequency component and encodes the frequency component. The acoustic signal encoding apparatus 200 converts each of multi-channel acoustic signals into a frequency component and normalizes the converted frequency component.

The acoustic signal encoding apparatus 200 quantizes the normalized frequency component and encodes the quantized frequency component in each channel. The acoustic signal encoding apparatus 200 multiplexes encoding data that is a quantization value encoded in each channel and encoding information on the encoding and outputs the multiplexed data as acoustic encoding data through a code sequence output line 201 to the network 110.

The network 110 is a connection network for connection between the acoustic signal encoding apparatus 200 and the acoustic signal decoding apparatus 400. The network 110 allows the acoustic encoding data output from the acoustic signal encoding apparatus 200 to be transmitted through a code sequence input line 202 to the acoustic signal decoding apparatus 400.

The acoustic signal decoding apparatus 400 generates an acoustic signal by decoding the acoustic encoding data supplied through the code sequence input line 202. The acoustic signal decoding apparatus 400 separates, for example, the acoustic encoding data into the encoding data of each channel and the encoding information and generates the encoding data, which is decoded based on the encoding information, as a quantization value. The acoustic signal decoding apparatus 400 generates the frequency component of the acoustic signal by performing inverse quantization and inverse normalization on the quantization value of each channel. The acoustic signal decoding apparatus 400 generates the acoustic signal of each channel by converting the generated frequency component into a time-domain signal and supplies the acoustic signal to the speaker 600.

The speaker 600 outputs the acoustic signal supplied from the acoustic signal decoding apparatus 400. The speaker 600 converts an electrical signal that is the acoustic signal of each channel supplied from the acoustic signal decoding apparatus 400 into a sound wave and outputs the sound wave.

In this manner, the acoustic signal processing system 100 may generate the acoustic encoding data, in which an information amount of the acoustic signal is compressed, by encoding the acoustic signal input from the acoustic signal input terminal 101 by using the acoustic signal encoding apparatus 200. In addition, the acoustic signal processing system 100 may reproduce the acoustic signal by decoding the acoustic encoding data by using the acoustic signal decoding apparatus 400.

Therefore, in the acoustic signal processing system 100, the acoustic signal in which an information amount is compressed by converting the acoustic signal input from the acoustic signal input terminal 101 into the acoustic encoding data may be transmitted to the network 110. In addition, the acoustic signal processing system 100 is an example of a signal processing system disclosed in the Claims. Next, an example of a configuration of the acoustic signal encoding apparatus 200 in the acoustic signal processing system 100 is described with reference to the drawings.

[Example of Configuration of Acoustic Signal Encoding Apparatus 200]

Figure 2:
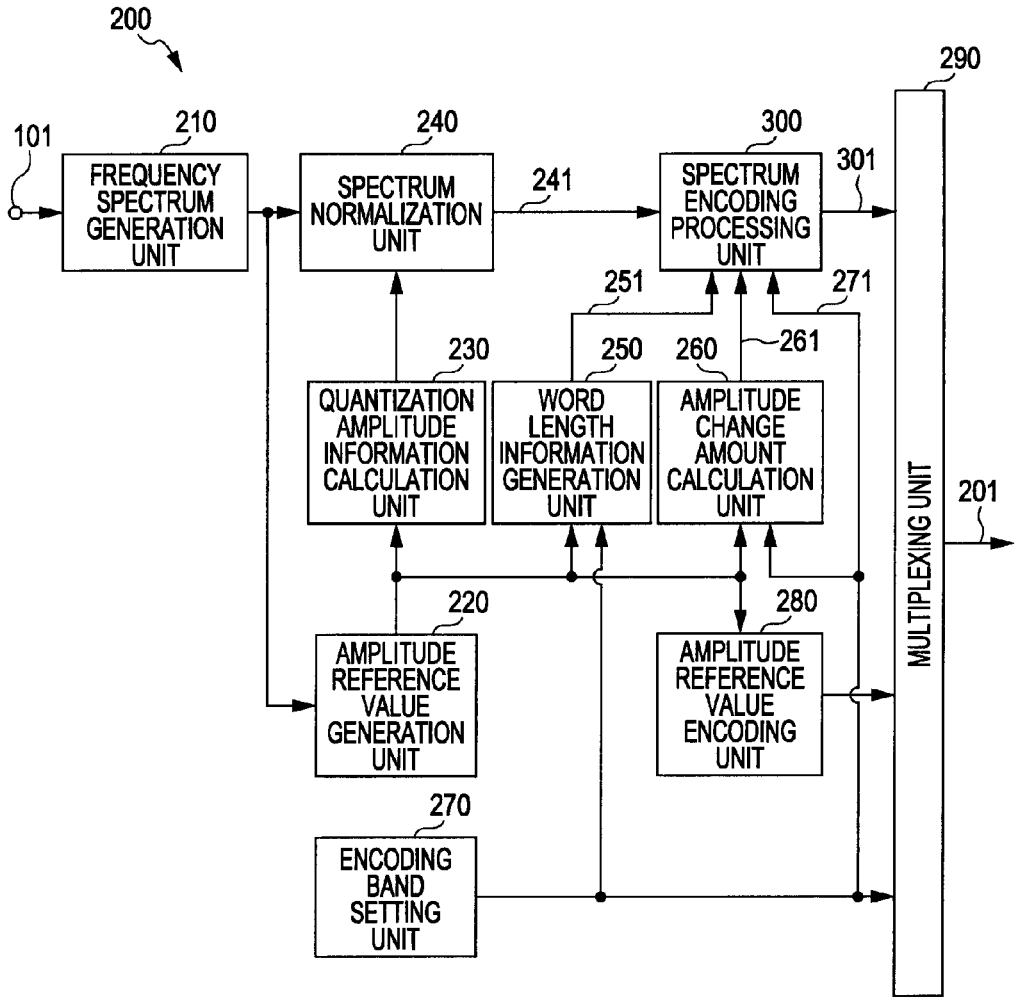
FIG. 2 is a block diagram illustrating an example of a configuration of an acoustic signal encoding apparatus according to a first embodiment of the invention.

FIG. 2 is a block diagram illustrating an example of a configuration of the acoustic signal encoding apparatus 200 according to the first embodiment of the invention.

The acoustic signal encoding apparatus 200 includes a frequency spectrum generation unit 210, an amplitude reference value generation unit 220, a quantization amplitude information calculation unit 230, a spectrum normalization unit 240, a word length information generation unit 250, and an amplitude change amount calculation unit 260. In addition, the acoustic signal encoding apparatus 200 includes an encoding band setting unit 270, an amplitude reference value encoding unit 280, a multiplexing unit 290, and a spectrum encoding process unit 300. In addition, the acoustic signal encoding apparatus 200 is an example of a signal encoding apparatus disclosed in the Claims.

The frequency spectrum generation unit 210 generates the frequency spectrum of the acoustic signal by converting the acoustic signal input from the acoustic signal input terminal 101 into the frequency component. The frequency spectrum generation unit 210 extracts the acoustic signal, which is a discrete time signal sampled in a constant time interval, in units of a frame of a constant sampling number. In addition, the frequency spectrum generation unit 210 generates the frequency spectrum by converting the extracted acoustic signal of each frame into a signal in a frequency domain.

The frequency spectrum generation unit 210 generates, for example, a Fourier coefficient, which is calculated through fast Fourier transform (FFT) on the acoustic signal in each channel input from the acoustic signal input terminal 101, as a frequency component. Alternatively, the frequency spectrum generation unit 210 generates an MDCT (modified discrete cosine transform) coefficient, which is calculated through the MDCT, as a frequency component. In addition, the frequency spectrum generation unit 210 supplies the generated frequency component to the amplitude reference value generation unit 220 and the spectrum normalization unit 240.

The amplitude reference value generation unit 220 generates an amplitude reference value which is used as a reference for normalizing an amplitude of the frequency spectrum generated by the frequency spectrum generation unit 210. The aforementioned amplitude reference value denotes, for example, a scale factor which is used as a reference of an amplitude level of the frequency spectrum. The amplitude reference value generation unit 220 divides the entire frequency band of the frequency spectrum supplied from the frequency spectrum generation unit 210 into predetermined subbands (scale factor bands) and extracts the frequency components corresponding to the subbands, in each of the subbands.

The amplitude reference value generation unit 220 generates the amplitude reference value with respect to each subband based on the amplitude level of the representative frequency component among the frequency components of that subband. The amplitude reference value generation unit 220 selects, for example, the frequency component having the maximum amplitude level in the subband among the frequency components in the subband and generates the amplitude reference value with respect to the subband based on the amplitude level of the selected frequency component. In other words, the amplitude reference value generation unit 220 generates the amplitude reference values with respect to the subbands based on the maximum amplitude levels of the frequency components in each of the subbands of the frequency spectrum.

The amplitude reference value generation unit 220 generates the amplitude reference value Ar[i] with respect to the i-th subband based on, for example, the following equation.

$$Ar[i] = \begin{cases} \lfloor \log_2 A_i + 1 \rfloor & (A_i \geq 1) \\ 0 & (A_i < 1) \end{cases} \quad \text{[Equation 1]}$$

In the above equation, $A_i$ denotes the amplitude level of the representative frequency component of the i-th subband among the frequency components corresponding to the i-th subband. In addition, i denotes an index of the subband. In addition, in the case where the amplitude level $A_i$ is equal to or larger than "1", a maximum integer value which does not exceeds "$\log_2 A_i+1$" is generated as the amplitude reference value Ar[i] according to the upper equation of Equation 1. In other words, a value which is obtained by omitting decimals of "$\log_2 A_i+1$" is generated as the amplitude reference value Ar[i].

The amplitude reference value generation unit 220 supplies the amplitude reference value Ar[i] with respect to each of the subbands to the quantization amplitude information calculation unit 230, the word length information generation unit 250, the amplitude change amount calculation unit 260, and the amplitude reference value encoding unit 280. In addition, the amplitude reference value generation unit 220 is an example of an amplitude reference value generation unit disclosed in the Claims.

The quantization amplitude information calculation unit 230 calculates quantization amplitude information for normalizing the frequency spectrum based on the amplitude reference value supplied from the amplitude reference value generation unit 220. The quantization amplitude information calculation unit 230 calculates the quantization amplitude information $A^{(q)}i$ with respect to each subband based on, for example, the following equation.

$$A^{(q)}_i = 2^{Ar[i]} \quad \text{[Equation 2]}$$

In addition, the quantization amplitude information calculation unit 230 supplies the quantization amplitude information $A^{(q)}i$ with respect to each subband, which is calculated based on the above equation, to the spectrum normalization unit 240.

The spectrum normalization unit 240 normalizes the frequency spectrum supplied from the frequency spectrum generation unit 210 based on the quantization amplitude information input from the quantization amplitude information calculation unit 230. The spectrum normalization unit 240 generates the normalization spectrum in each subband by normalizing the amplitude level of the frequency component corresponding to the subband based on the amplitude reference value with respect to the subband input from the quantization amplitude information calculation unit 230.

The spectrum normalization unit 240 calculates a level N[m] of the normalization spectrum based on the quantization amplitude information $A^{(q)}i$ with respect to the i-th subband and the amplitude level X[m] of each frequency component corresponding to the i-th subband by using, for example, the following equation.

$$N[m]=X[m]/A^{(q)}{}_i(m_i \leq m < m_{i+1}) \quad \text{[Equation 3]}$$

In the above equation, m denotes a frequency number corresponding to a frequency of a frequency component in the i-th subband the frequency spectrum. In addition, $m_i$ denotes the lowest frequency number among the frequency numbers of the frequency components in the i-th subband. In addition, $m_{i+1}$ denotes the lowest frequency number among the frequency numbers of the frequency components in the (i+1)-th subband.

In the above Equation 3, the spectrum normalization unit 240 generates the normalization spectrum N[m] corresponding to the i-th subband based on the quantization amplitude information $A^{(q)}i$ in the i-th subband and each frequency component amplitude X[m] corresponding to the i-th subband. Therefore, the range of value of the normalization spectrum N[m] is "−1.0" to "1.0". In addition, the spectrum normalization unit 240 supplies the normalization spectrum through the signal line 241 to the spectrum encoding process unit 300.

The word length information generation unit 250 generates word length information (word length), which define a quantization accuracy, in each subband based on the amplitude reference value corresponding to each subband, which is input from the amplitude reference value generation unit 220. The word length information generation unit 250 generates the word length information with respect to each subband by performing, for example, a weighting operation on all the amplitude reference values by taking into consideration human auditory characteristics.

In addition, the word length information generation unit 250 generates the word length information which is limited to the to-be-encoded subband which is specified by the number of the encoding bands input from a signal line 271. In addition, the word length information generation unit 250 supplies the generated word length information through a signal line 251 to the spectrum encoding process unit 300.

The amplitude change amount calculation unit 260 calculates the amplitude change amount of the frequency spectrum generated by the frequency spectrum generation unit 210 based on the amplitude reference values corresponding to each subband, which are supplied from the amplitude reference value generation unit 220. In other words, the amplitude change amount calculation unit 260 calculates the amplitude change amount of the frequency spectrum based on a spectrum envelope of the frequency spectrum in the acoustic signal.

The amplitude change amount calculation unit 260 calculates the amplitude change amount in each subband based on the amplitude reference value with respect to the change amount calculation band, which is a predetermined subband among the plurality of the subbands. In addition, the amplitude change amount calculation unit 260 calculates the amplitude change amount, which is limited to the to-be-encoded subband, which, in turn, is specified by the number of the encoding bands input from the signal line 271.

The amplitude change amount calculation unit 260 calculates the amplitude change amount of the frequency spectrum based on each amplitude reference value with respect to the change amount calculation band, by using, for example, each subband in the vicinity of the subband where the amplitude change amount is to be calculated as a change amount calculation band. In this example, the amplitude change amount calculation unit 260 calculates the amplitude change amount with respect to the subband based on, for example, a difference of the amplitude reference values of adjacent subbands as the change amount calculation band.

In addition, the amplitude change amount calculation unit 260 determines based on the amplitude change amount with respect to each subband whether or not the amplitude change amount with respect to the subband is large. For example, in the case where the calculated amplitude change amount exceeds a predetermined change amount threshold value, the amplitude change amount calculation unit 260 generates an amplitude change determination flag indicating that the subband has a large amplitude change amount. On the other hand, in the case where the amplitude change amount does not exceed the predetermined change amount threshold value, the amplitude change amount calculation unit 260 generates an amplitude change determination flag indicating that the subband has a small amplitude change amount.

The amplitude change amount calculation unit 260 determines based on, for example, the conditional equations in the following equation whether or not the amplitude change amount with respect to the i-th subband is large.

$$\begin{cases} Ar[i] - Ar[i-1] \geq Th1 & (1 \leq i < NC) \\ 2 \cdot Ar[i] - (Ar[i-1] + Ar[i+1]) \geq Th2 & (1 \leq i < NC-1) \end{cases} \quad \text{[Equation 4]}$$

In the above equation, Th1 and Th2 denote first and second change amount threshold values. In addition, NC denotes an encoding band number indicating a number of a maximum subband among the to-be-encoded subbands. In addition, in the upper conditional equation of Equation 4, the (i−1)-th and i-th subbands are the change amount calculation bands. In addition, in the lower conditional equation of Equation 4, the (i−1)-th to (i+1)-th subbands are the change amount calculation bands.

The amplitude change amount calculation unit 260 calculates the amplitude change amount with respect to the i-th subband based on a difference between the amplitude reference value Ar[i] of the i-th subband and the amplitude reference value Ar[i−1] of the (i−1)-th subband adjacent to the low band side of the i-th subband by using the upper conditional equation of Equation 4. Next, the amplitude change amount calculation unit 260 determines whether or not the calculated amplitude change amount is equal to or larger than the first change amount threshold value Th1. In other words, the amplitude change amount calculation unit 260 determines by using the amplitude reference value with respect to the subband adjacent to the low band side as a comparison object whether or not the subband has a large amplitude change amount.

In addition, the amplitude change amount calculation unit 260 calculates a product value (2×Ar[i]) by multiplying "2" to the amplitude reference value with respect to the i-th subband by using the lower conditional equation of Equation 4. In addition, the amplitude change amount calculation unit 260 calculates a sum value (Ar[i−1]+Ar[i+1]) of the amplitude reference values of the (i−1)-th and (i+1)-th subbands adjacent to the two sides of the i-th subband.

Next, the amplitude change amount calculation unit 260 calculates the amplitude change amount with respect to the i-th subband by subtracting the sum value (Ar[i−1]+Ar[i+1]) from the product value (2×Ar[i]). Next, the amplitude change amount calculation unit 260 determines whether or not the calculated amplitude change amount is equal to or larger than the second change amount threshold value Th2. In other words, the amplitude change amount calculation unit 260 determines by using an average value of the amplitude reference values with respect to the subbands adjacent to the two band sides as comparison objects whether or not the subband has a large amplitude change amount.

In addition, the amplitude change amount calculation unit 260 determines that a subband satisfying one of the two conditional equations expressed in Equation 4 is the subband having a larger amplitude change amount than the adjacent subbands. In other words, the amplitude change amount calculation unit 260 determines that a subband of which the amplitude reference value exceeds a predetermined magnitude in comparison with the amplitude reference value of the adjacent subband is the subband having a larger amplitude reference value than the adjacent subbands.

For example, in the case where the subband is determined to be the subband having a large amplitude change amount, the amplitude change amount calculation unit 260 sets the amplitude change determination flag to "1". In the case where the subband is determined not to be the subband having a large amplitude change amount, the amplitude change amount calculation unit 260 sets the amplitude change determination flag to "0".

In addition, the amplitude change amount calculation unit 260 supplies the designated amplitude change determination flag to the spectrum encoding process unit 300. In addition, in this embodiment, although an example of calculating the amplitude change amount based on the amplitude reference value with respect to the subband is described, the amplitude change amount may be calculated based on a spectrum envelope which is generated by a linear prediction analysis or a cepstrum analysis. The amplitude change amount calculation unit 260 is an example of an amplitude change amount calculation unit disclosed in the Claims.

The encoding band setting unit 270 sets an upper limit of the encoding band, where the frequency spectrum is to be encoded, among the entire frequency bands of the frequency spectrum generated by the frequency spectrum generation unit 210. The encoding band setting unit 270 sets the number of the upper limit of the subband as the number of encoding bands based on the encoding rate of the acoustic signal. In addition, the encoding rate of the acoustic signal is supplied to a central processing unit (CPU), which is not illustrated in the figure. In addition, the encoding band setting unit 270 supplies the designated number of encoding bands through a signal line 271 to the amplitude change amount calculation unit 260, the multiplexing unit 290, and the spectrum encoding process unit 300.

The spectrum encoding process unit 300 performs the encoding process on the normalization spectrum supplied from the spectrum normalization unit 240. The spectrum encoding process unit 300 encodes the normalization spectrum input from the spectrum normalization unit 240 based on the outputs of the word length information generation unit 250, the amplitude change amount calculation unit 260, and the encoding band setting unit 270.

The spectrum encoding process unit 300 generates the integer data that is a quantization value in each subband by converting the normalization spectrum in the subband based on the word length information input from the word length information generation unit 250. In addition, the spectrum encoding process unit 300 selects one encoding algorithm among the plurality of the encoding algorithms based on the amplitude change determination flag input from the amplitude change amount calculation unit 260.

In addition, the spectrum encoding process unit 300 encodes the generated integer data through the selected encoding algorithm. In addition, the spectrum encoding process unit 300 supplies the encoded integer data as encoding data through a signal line 301 to the multiplexing unit 290.

The amplitude reference value encoding unit 280 encodes the amplitude reference value with respect to each subband, which is input from the amplitude reference value generation unit 220. The amplitude reference value encoding unit 280 supplies the encoded amplitude reference value to the multiplexing unit 290.

The multiplexing unit 290 multiplexes the encoding data input from the spectrum encoding process unit 300, the encoded amplitude reference value input from the amplitude reference value encoding unit 280, and the number of encoding bands input from the encoding band setting unit 270 into one code sequence (bitstream). In other words, the multiplexing unit 290 generates the acoustic encoding data by multiplexing the encoding data, the encoded amplitude reference value, and the number of encoding bands through temporal division. In addition, the multiplexing unit 290 outputs the generated acoustic encoding data as one code sequence to the code sequence output line 201.

In this manner, the amplitude change amount calculation unit 260 is provided, so that it is possible to determine that the subband having a larger amplitude reference value than the adjacent subband is the subband having a large amplitude change amount. Accordingly, the acoustic signal encoding apparatus 200 may encode the integer data that is a quantization value through the encoding algorithm according to the amplitude change amount. Now, an example of determination of the amplitude change amount in each subband in the amplitude change amount calculation unit 260 is described with reference to the drawings.

[Example of Determination of Amplitude Change Amount in Amplitude Change Amount Calculation Unit 260]

Figure 3A:
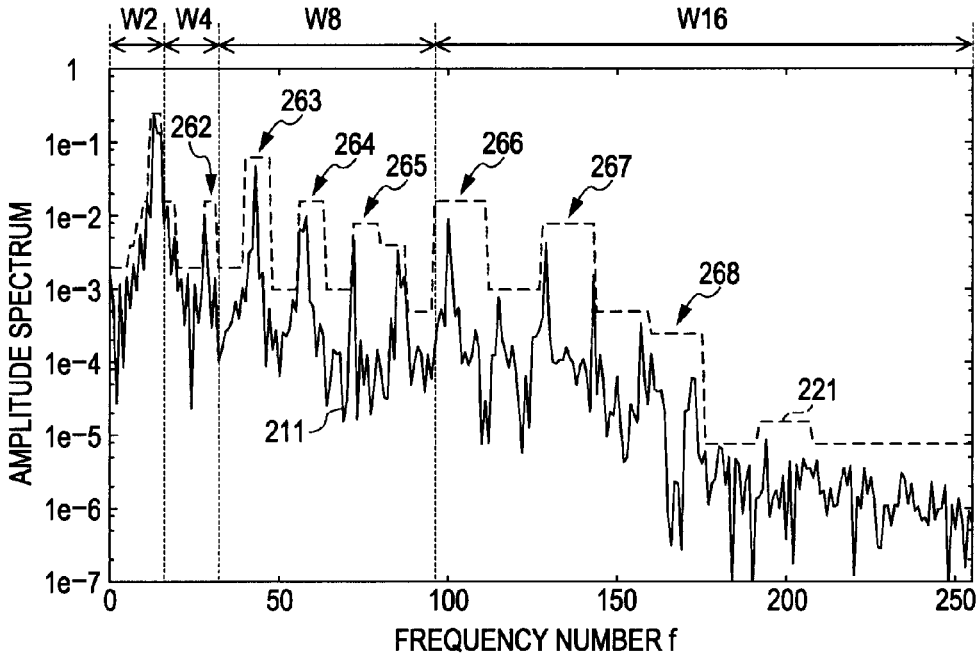
FIGS. 3A and 3B are diagrams illustrating an example of determination of an amplitude change amount with respect to each subband by an amplitude change amount calculation unit according to the first embodiment of the invention.
Figure 3B:
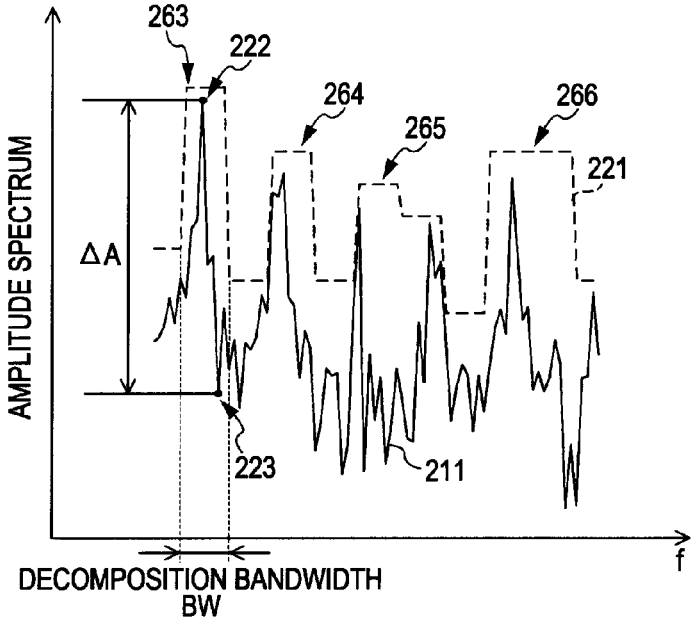

FIGS. 3A and 3B are diagrams illustrating an example of determination of the amplitude change amount in each subband in the amplitude change amount calculation unit 260 according to the first embodiment of the invention. FIG. 3A is a conceptual diagram illustrating the large-change-in-amplitude subbands 262 to 268 that are determined to have a large amplitude change amount of the frequency spectrum in the subband based on the amplitude reference value by the amplitude change amount calculation unit 260. FIG. 3B is an enlarged diagram illustrating a vicinity of the large-change-in-amplitude subband 263 illustrated in FIG. 3A.

In this example, a conversion length for converting one frame into frequency spectrums is set to 256. In other words, with respect to one frame, 256 frequency spectrums are generated by the frequency spectrum generation unit 210. In addition, in this example, the horizontal axis is set to the frequency number f corresponding to a frequency, and the vertical axis is set to the amplitude spectrum. The amplitude spectrum is a logarithm expression of a magnitude (level) of a frequency spectrum.

In FIG. 3A, a frequency spectrum 211, a quantization amplitude information line $A^{(q)}i$ 221 based on an amplitude reference value Ar[i], and large-change-in-amplitude subbands 262 to 268 are illustrated. In addition, in the figure, subband widths W2, W4, W8, and W16 indicating the number of the frequency spectrums in each subband are illustrated.

The frequency spectrum 211 indicated by a solid line is an example of the frequency spectrum generated based on the acoustic signal by the frequency spectrum generation unit 210. The frequency spectrum 211 includes many pulse-like waveforms, where the amplitude of the frequency spectrum is greatly increased, in a bandwidth which is much narrower than those of the adjacent frequencies. In addition, as a whole, with respect to the frequency spectrum 211, as the frequency thereof is increased, the amplitude spectrum is gradually decreased.

The quantization amplitude information line 221 indicated by a broken line is a line indicating the quantization amplitude information based on the amplitude reference value with respect to each subband generated by the amplitude reference value generation unit 220. Since the amplitude reference value is generated based on the maximum amplitude level of the frequency components included in each of the predetermined subbands, the quantization amplitude information line 221 indicates a whole spectrum envelope with respect to the frequency spectrum.

The large-change-in-amplitude subbands 262 to 268 are subbands which satisfy at least one of the two conditional equations in Equation 4 and where the amplitude change amount of the amplitude reference value is determined to be large by the amplitude change amount calculation unit 260. In other words, in the large-change-in-amplitude subbands 262 to 268, the amplitude reference values thereof are somewhat larger than the amplitude reference values of the adjacent subbands.

In this manner, since the pulse-like waveforms of the frequency spectrum 211 are included in the large-change-in-amplitude subbands 262 to 268 determined based on Equation 4 by the amplitude change amount calculation unit 260, the difference in the amplitude level of those frequency components is large in comparison with other subbands. Now, as an example, the difference in the amplitude level of the frequency components in the large-change-in-amplitude subband 263 is described in brief with reference to FIG. 3B.

In FIG. 3B, a local maximum point 222 and a local minimum point 223 of the frequency components in the large-change-in-amplitude subband 263 illustrated in FIG. 3A are illustrated. In addition, since the bandwidth BW of the large-change-in-amplitude subband 263 is included in the frequency band of the subband width W8, the bandwidth BW is the bandwidth corresponding to the 8 frequency spectrums.

The local maximum point 222 indicates an amplitude level of the frequency spectrum of which the amplitude is largest among the frequency spectrums included in the bandwidth BW of the large-change-in-amplitude subband 263. Due to the local maximum point 222, a pulse-like waveform occurs in a frequency characteristic of an acoustic signal.

The local minimum point 223 indicates an amplitude level of the frequency component of which the amplitude is smallest among the frequency components included in the bandwidth BW of the large-change-in-amplitude subband 263. The amplitude level indicated by the local minimum point 223 is substantially equal to the amplitudes of the adjacent frequency components.

In this manner, it is understood that the difference ΔA in the amplitude level of the frequency components in the large-change-in-amplitude subband 263 is larger than those in the subbands other than the large-change-in-amplitude subbands 262 to 268. In other words, in the subband of which the amplitude reference value is larger than those of the adjacent subbands among the plurality of the subbands, since only the amplitudes of a very small portion of the frequency components in the subband tend to be greatly increased, the difference in the amplitude level of the frequency components in the subband is increased.

In this manner, in the first embodiment of the invention, the amplitude change amount calculation unit 260 is provided, so that it is possible to determine the subbands 262 to 268 having a large amplitude change amount with reference to the amplitude reference values with respect to the adjacent subbands based on the conditional equations expressed in Equation 4. Accordingly, it is possible to specify the subbands 262 to 268 of which the difference in the amplitude level of the frequency components in the subband is large. Next, a result of analysis of an occurrence probability distribution of a quantization value according to the amplitude level difference of the frequency components in the subband is described with reference to the drawings.

[Relationship Between Amplitude Change Amount of Frequency Spectrum and Occurrence Probability Distribution of Quantization Value]

Figure 4:
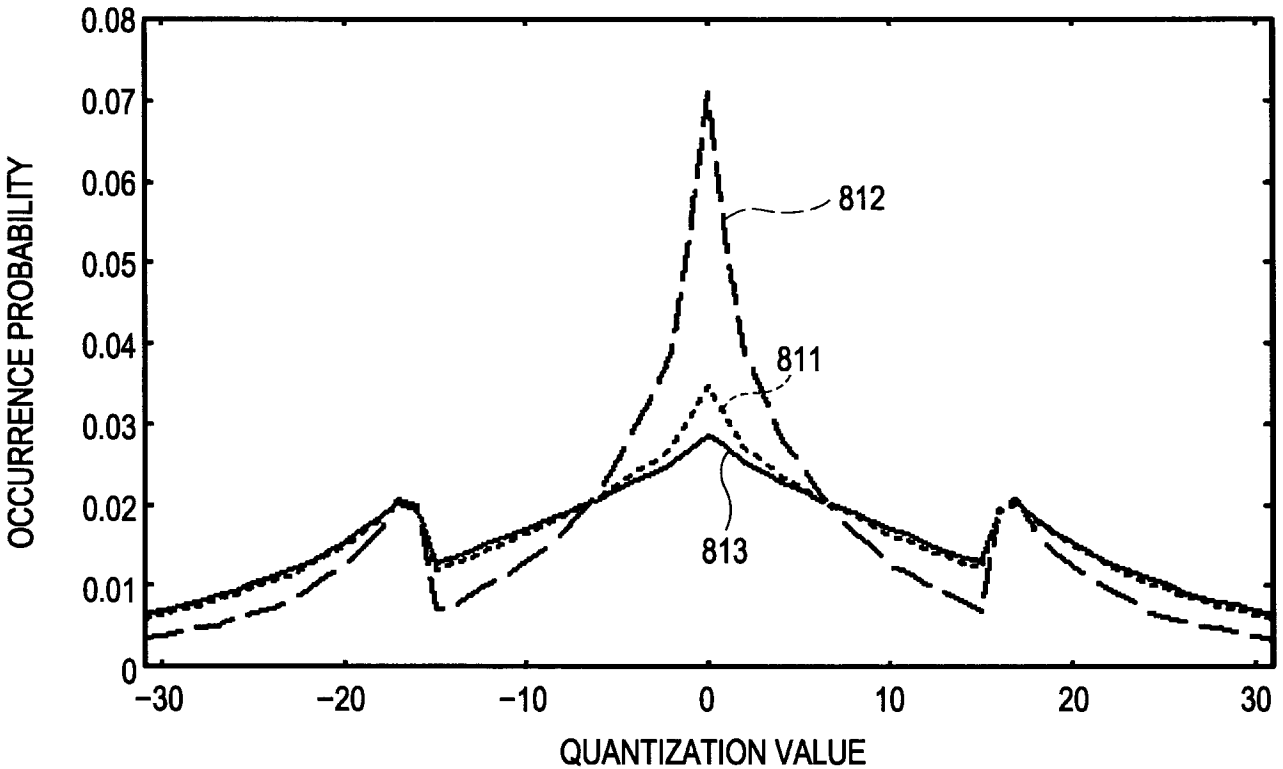
FIG. 4 is a diagram illustrating an example of an occurrence probability distribution of a quantization value corresponding to a subband in a subband width among subbands where amplitude change amounts are determined to be large by the amplitude change amount calculation unit.

FIG. 4 is a diagram illustrating an example of an occurrence probability distribution of a quantization value corresponding to the subband in the subband width W4 among the subbands where amplitude change amounts are determined to be large by the amplitude change amount calculation unit 260.

In the figure, a total occurrence probability distribution 811, a large-change-in-amplitude occurrence probability distribution 812, and a small-change-in-amplitude occurrence probability distribution 813 are illustrated. In this example, in the case where the normalization spectrum having a range of "−1" to "1" is converted into the quantization value of "−31" to "31" by equal quantization, the occurrence probability distribution of the quantization value is illustrated. In addition, in the figure, the horizontal axis is set to a quantization value, and the vertical axis is set to an occurrence probability.

The total occurrence probability distribution 811 indicated by a dotted line is an occurrence probability distribution of the quantization value in the entire subbands having the subband width W4. The total occurrence probability distribution 811 indicates a flat distribution where the degree of deflection of the occurrence probability distribution is relatively small.

The large-change-in-amplitude occurrence probability distribution 812 indicated by a broken line is an occurrence probability distribution of the quantization value in the subband where the amplitude change amount is determined to be large based on Equation 4 by the amplitude change amount calculation unit 260. In other words, the large-change-in-amplitude occurrence probability distribution 812 is an occurrence probability distribution of the quantization value in the subband having a large amplitude change amount. In the large-change-in-amplitude occurrence probability distribution 812, the degree of deflection of the occurrence probability distribution of the quantization value is large, and the occurrence probability is high in the vicinity of the quantization value "0".

The small-change-in-amplitude occurrence probability distribution 813 indicated by a solid line is an occurrence probability distribution of the quantization value in the subband where the amplitude change amount is not determined to be large by the amplitude change amount calculation unit 260 because any one of conditions of Equation 4 is not satisfied. In other words, the small-change-in-amplitude occurrence probability distribution 813 is an occurrence probability distribution in the subband having a flat waveform where a difference in the amplitude level is small. The small-change-in-amplitude occurrence probability distribution 813 indicates a flat occurrence probability distribution where the degree of deflection of the occurrence probability distribution of the quantization value is small.

In this manner, among the subbands in the subband width W4, the degree of deflection of the occurrence probability distribution of the quantization value corresponding to the subband where the amplitude change amount is determined to be large by the amplitude change amount calculation unit 260 is large, and the occurrence probability is high in the vicinity of the quantization value "0". Next, the occurrence probability distribution of the quantization value corresponding to the subband in the subband width W8 is described with reference to the drawings.

Figure 5:
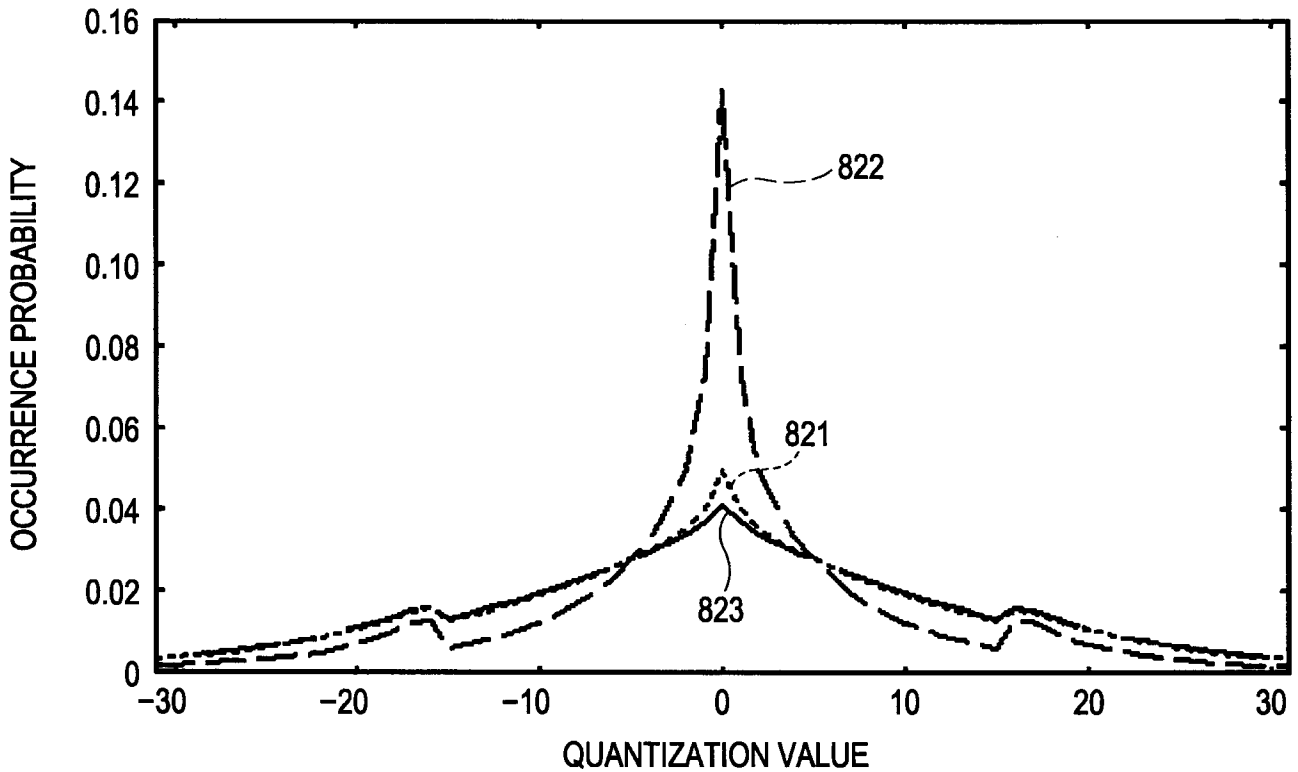
FIG. 5 is a diagram illustrating an example of an occurrence probability distribution of a quantization value corresponding to a subband in a subband width among subbands where amplitude change amounts are determined to be large by the amplitude change amount calculation unit.

FIG. 5 is a diagram illustrating an example of an occurrence probability distribution of a quantization value corresponding to the subband in the subband width W8 among the subbands where amplitude change amounts are determined to be large by the amplitude change amount calculation unit 260.

In the figure, a total occurrence probability distribution 821, a large-change-in-amplitude occurrence probability distribution 822, and a small-change-in-amplitude occurrence probability distribution 823 are illustrated. In this example, similarly to FIG. 4, in the case where the normalization spectrum having a range of "−1" to "1" is converted into the quantization value of "−31" to "31" by equal quantization, the occurrence probability distribution of the quantization value is illustrated. In addition, in the figure, the horizontal axis is set to a quantization value, and the vertical axis is set to an occurrence probability.

The total occurrence probability distribution 821 indicated by a dotted line is an occurrence probability distribution of the quantization value in the entire subbands having the subband width W8. Similarly to the total occurrence probability distribution 811 illustrated in FIG. 4, the total occurrence probability distribution 831 indicates a flat distribution where the degree of deflection of the occurrence probability distribution is relatively small.

The large-change-in-amplitude occurrence probability distribution 822 indicated by a broken line is an occurrence probability distribution of the quantization value in the subband where the amplitude change amount is determined to be large based on Equation 4 by the amplitude change amount calculation unit 260. Similarly to the large-change-in-amplitude occurrence probability distribution 812 illustrated in FIG. 4, in the large-change-in-amplitude occurrence probability distribution 822, the degree of deflection of the occurrence probability distribution of the quantization value is large, and the occurrence probability is high in the vicinity of the quantization value "0".

The small-change-in-amplitude occurrence probability distribution 823 indicated by a solid line is an occurrence probability distribution of the quantization value in the subband where the amplitude change amount is determined not to be large by the amplitude change amount calculation unit 260 because any one of conditions of Equation 4 is not satisfied. Similarly to the large-change-in-amplitude occurrence probability distribution 812 and 822 illustrated in FIGS. 4 and 5, the small-change-in-amplitude occurrence probability distribution 823 indicates a flat occurrence probability distribution where the degree of deflection of the occurrence probability distribution of the quantization value is small.

Figure 6:
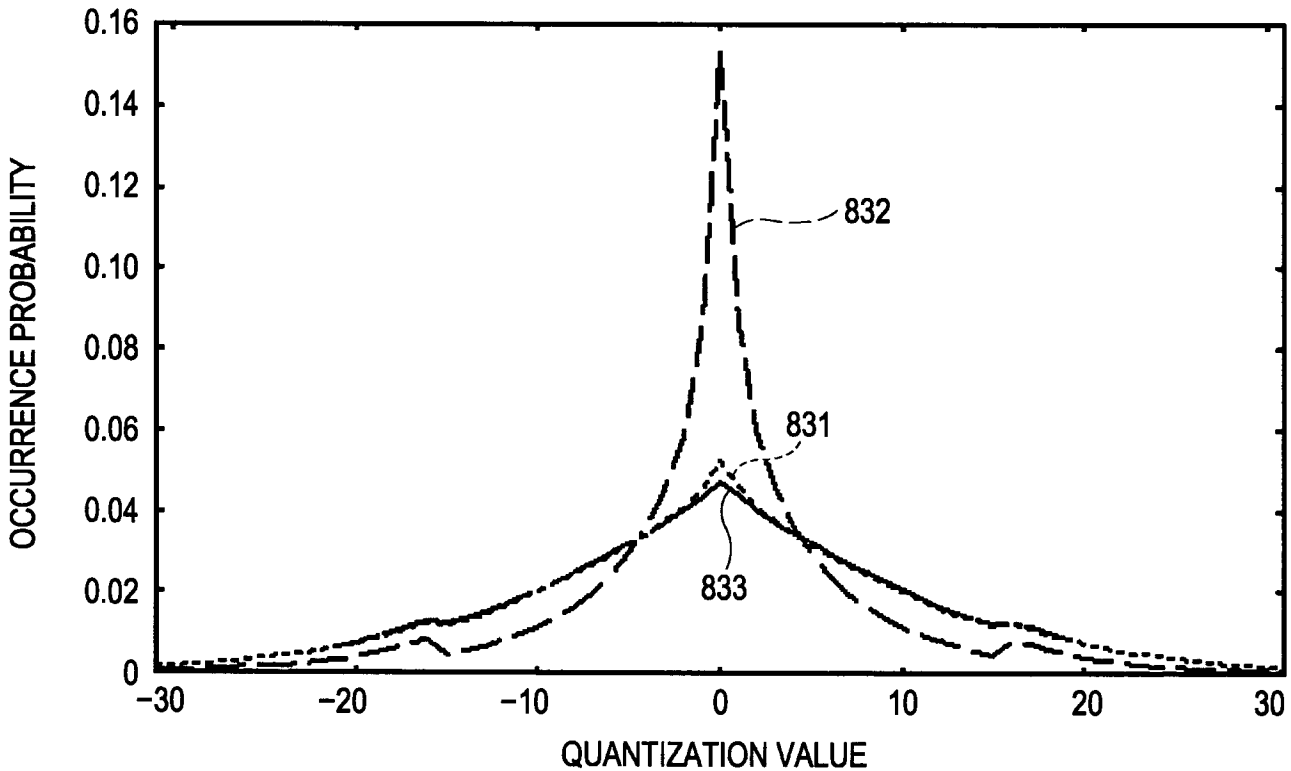
FIG. 6 is a diagram illustrating an example of an occurrence probability distribution of a quantization value corresponding to a subband in a subband width among subbands where amplitude change amounts are determined to be large by the amplitude change amount calculation unit.

In this manner, in the subbands in the subband width W8, the degree of deflection of the occurrence probability distribution of the quantization value is determined to be large by the amplitude change amount calculation unit 260 is large, and the occurrence probability is high in the vicinity of the quantization value "0". In addition, in comparison with the large-change-in-amplitude occurrence probability distribution 812 in the subband width W4, in the large-change-in-amplitude occurrence probability distribution 822 in the subband width W4, the occurrence probability is high in the vicinity of the quantization value "0", and the degree of deflection of the occurrence probability distribution is large. Next, the occurrence probability distribution of the quantization value corresponding to the subband in the subband width W16 is described with reference to the drawings. FIG. 6 is a diagram illustrating an example of an occurrence probability distribution of a quantization value corresponding to the subband in the subband width W16 among the subbands where amplitude change amounts are determined to be large by the amplitude change amount calculation unit 260.

In this figure, a total occurrence probability distribution 831, a large-change-in-amplitude occurrence probability distribution 832, and a small-change-in-amplitude occurrence probability distribution 833 are illustrated. In this example, similarly to FIGS. 4 and 5, in the case where the normalization spectrum having a range of "−1" to "1" is converted into the quantization value of "−31" to "31" by equal quantization, the occurrence probability distribution of the quantization value is illustrated. In addition, in the figure, the horizontal axis is set to a quantization value, and the vertical axis is set to an occurrence probability.

The total occurrence probability distribution 831 indicated by a dotted line is an occurrence probability distribution of the quantization value in the entire subbands having the subband width W8. Similarly to the total occurrence probability distributions 811 and 821 illustrated in FIGS. 4 and 5, the total occurrence probability distribution 831 indicates a flat distribution where the degree of deflection of the occurrence probability distribution is relatively small.

The large-change-in-amplitude occurrence probability distribution 832 indicated by a broken line is an occurrence probability distribution of the quantization value in the subband where the amplitude change amount is determined to be large based on Equation 4 by the amplitude change amount calculation unit 260. Similarly to the large-change-in-amplitude occurrence probability distributions 812 and 813 illustrated in FIGS. 4 and 5, in the large-change-in-amplitude occurrence probability distribution 832, the degree of deflection of the occurrence probability distribution of the quantization value is large, and the occurrence probability is high in the vicinity of the quantization value "0".

The small-change-in-amplitude occurrence probability distribution 833 indicated by a solid line is an occurrence probability distribution of the quantization value in the subband where the amplitude change amount is determined not to be large by the amplitude change amount calculation unit 260 because any one of conditions of Equation 4 is not satisfied. Similarly to the large-change-in-amplitude occurrence probability distributions 812 and 822 illustrated in FIGS. 4 and 5, the small-change-in-amplitude occurrence probability distribution 833 indicates a flat occurrence probability distribution where the degree of deflection of the occurrence probability distribution of the quantization value is small.

In this manner, the large-change-in-amplitude occurrence probability distribution 832 in the subband width W16 indicates an occurrence probability distribution which is substantially the same as the large-change-in-amplitude occurrence probability distribution 822 in the subband width W8. In addition, in the subbands in the subband width W16, the degree of deflection of the occurrence probability distribution of the quantization value corresponding to the subband where the amplitude change amount is determined to be large by the amplitude change amount calculation unit 260 is large, and the occurrence probability is high in the vicinity of the quantization value "0".

Accordingly, irrespective of the subband width, the degree of deflection of the occurrence probability distribution of the quantization value corresponding to the subband where the amplitude change amount is determined to be large by the amplitude change amount calculation unit 260 is large, so that the occurrence probability is high in the vicinity of the quantization value "0". Therefore, in the case of encoding the frequency spectrum indicating a plurality of pulse-like waveforms, if the quantization values are encoded by using a single encoding algorithm, the encoding efficiency is greatly decreased because the degree of deflection of the occurrence probability distribution of the quantization value is different among the subbands.

Now, an example of a configuration of the spectrum encoding process unit 300 which encodes the quantization value by the encoding algorithm according to the amplitude change amount of the frequency spectrum in the subband among the plurality of the encoding algorithms is described with reference to the drawings.

[Example of Configuration of Spectrum Encoding Process Unit 300]

Figure 7:
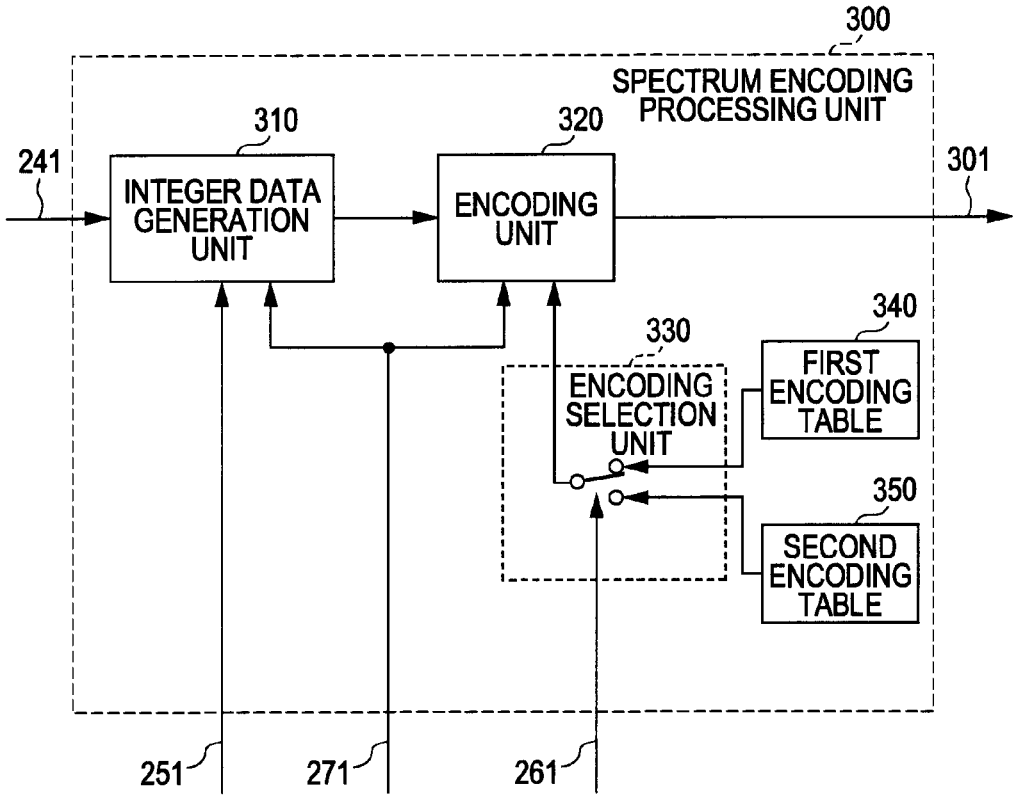
FIG. 7 is a block diagram illustrating an example of a configuration of a spectrum encoding process unit according to the first embodiment of the invention.

FIG. 7 is a block diagram illustrating an example of a configuration of the spectrum encoding process unit 300 according to the first embodiment of the invention.

The spectrum encoding process unit 300 includes an integer data generation unit 310, an encoding unit 320, an encoding selection unit 330, and first and second encode tables 340 and 350. In this example, it is considered that the quantization value of the frequency spectrum is encoded by two Huffman encoding algorithms based on the first and second encode tables 340 and 350 as the plurality of the encoding algorithms.

The integer data generation unit 310 generates the integer data by converting the normalization spectrum, which is supplied through a signal line 241 from the spectrum normalization unit 240, into the quantization value in each subband based on the word length information supplied through a signal line 251. The integer data generation unit 310 converts the normalization spectrum into the integer data in each subband, by using a predetermined function according to the word length information which defines the quantization accuracy.

The integer data generation unit 310 generates an integer data I[m] corresponding to the i-th subband, for example, by a function $F_I$ expressed in the following equation according to word length information WL[i] corresponding to the i-th subband. In this example, the word length information WL[i] is set to the number of non-encoding quantization bits.

$$I[m]=F_I(N[m],WL[i]) \quad \text{[Equation 5]}$$

The function $F_I$ in the above equation may be expressed, for example, by the following equation.

$$F_I(N[m],WL[i])=\lfloor(N[m]+1.0)\cdot(2^{WL[i]}-0.5)\rfloor-(2^{WL[i]}-1) \quad \text{[Equation 6]}$$

By Equations 5 and 6, the normalization spectrum N[m] having a range of "1" to "−1" is converted into the integer data I[m], which is a quantization value, based on word length information WL[i]. For example, in the case where the word length information WL[i] indicates "2", the normalization spectrum corresponding to the i-th subband is converted into the integer data I[m] having a range of "−3" to "3".

In addition, the integer data generation unit 310 specifies a to-be-encoded subband by the number of encoding bands supplied through a signal line 271 from the encoding band setting unit 270 and converts the normalization spectrum in the specified subband into the integer data. In addition, the integer data generation unit 310 supplies the converted integer data to the encoding unit 320 with respect to each subband.

The encoding unit 320 encodes the quantization value of the frequency spectrum in the input signal according to a plurality of encoding algorithms. The encoding unit 320 encodes the integer data that is a quantization value input from the integer data generation unit 310 by referring to the encode list stored in one of the first and second encode tables 340 and 350. In other words, the encoding unit 320 encodes the integer data input from the integer data generation unit 310 according to one of the two encoding algorithms.

In addition, the encoding unit 320 encodes the integer data in the to-be-encoded subband, which is specified by the number of encoding bands from the signal line 271, in each subband. In addition, the encoding unit 320 outputs the encoded integer data as an encoding data to a signal line 301. In addition, the encoding unit 320 is an example of an encoding unit disclosed in the Claims.

The first and second encode tables 340 and 350 are encode tables which store encode lists previously generated through the Huffman encoding. The first encode table 340 stores an encode list for encoding the integer data which is a quantization value of which the degree of deflection of the occurrence probability distribution in the subband is small. The encode list stored in the first encode table 340 is previously generated by using an occurrence probability distribution of the quantization value based on the small-amplitude-change-amount occurrence probability distributions 813 to 833 illustrated in FIGS. 4 to 6. In addition, the first encode table 340 outputs the stored encode list to the encoding selection unit 330.

The second encode table 350 stores an encode list for encoding the integer data which is a quantization value of which the degree of deflection of the occurrence probability distribution in the subband is small. The encode list stored in the second encode table 350 is previously generated by using an occurrence probability distribution of the quantization value based on the large-amplitude-change-amount occurrence probability distributions 812 to 832 illustrated in FIGS. 4 to 6. In addition, the second encode table 350 outputs the stored encode list to the encoding selection unit 330.

The encoding selection unit 330 selects one of the outputs of the first and second encode tables 340 and 350 based on the amplitude change determination flag supplied through the signal line 261 from the amplitude change amount calculation unit 260. In the case where an amplitude change determination flag indicating that the amplitude change amount of the amplitude reference value is large is supplied, the encoding selection unit 330 selects the output of the second encode table 350 which stores the encode list for encoding the quantization value of which the degree of deflection of the occurrence probability distribution in the subband is large.

On the other hand, in the case where an amplitude change determination flag indicating that the amplitude change amount of the amplitude reference value is small is supplied, the encoding selection unit 330 selects the output of the first encode table 340 which stores the encode list for encoding the quantization value of which the degree of deflection of the occurrence probability distribution in the subband is small. In other words, the encoding selection unit 330 selects the encoding algorithm according to the degree of deflection of the occurrence probability distribution of the quantization value in the amplitude change amount among the plurality of the encoding algorithms.

More specifically, for example, in the case where the amplitude change determination flag is set to "1", the encoding selection unit 330 selects the output of the second encode table 350. In addition, in the case where the amplitude change amount determination flag is set to "0", the encoding selection unit 330 selects the output of the first encode table 340.

In addition, the encoding selection unit 330 supplies an output of the selected first or second encode table 340 or 350 to the encoding unit 320. In other words, the encoding selection unit 330 allows the encoding unit 320 to refer to the output of the selected first or second encode table 340 or 350, so that the encoding unit 320 is allowed to generate the encoding data according to the magnitude of the amplitude change amount. In addition, the encoding selection unit 330 is an example of an encoding selection unit disclosed in the Claims.

In this manner, two encode tables, that is, the first and second encode tables 340 and 350 are provided, so that it is possible to generate the encoding data according to the degree of deflection of the occurrence probability distribution of the quantization value. In addition, the encoding selection unit 330 is provided, so that it is possible to select the encoding algorithm corresponding to the degree of deflection of the occurrence probability distribution of the quantization value according to the amplitude change amount generated based on the amplitude reference values of the adjacent subbands.

Accordingly, the acoustic signal encoding apparatus 200 may improve the encoding efficiency of the encoding data generated by the encoding unit 320. In addition, in this embodiment, although an example where the two encode tables, that is, the first and second encode tables 340 and 350 are provided is described, three or more encode tables may be provided. In this case, three or more steps are set as the reference of determination of the amplitude change amount with respect to the subband, and the plurality of the encode tables are switched according to the determination result. Accordingly, it is possible to implement an encoding process adaptable to the change in the occurrence probability distribution of the quantization value in the amplitude change amount.

[Example of Operations of Acoustic Signal Encoding Apparatus 200]

Now, the operations of the acoustic signal encoding apparatus 200 according to the first embodiment of the invention are described with reference to the drawings.

Figure 8:
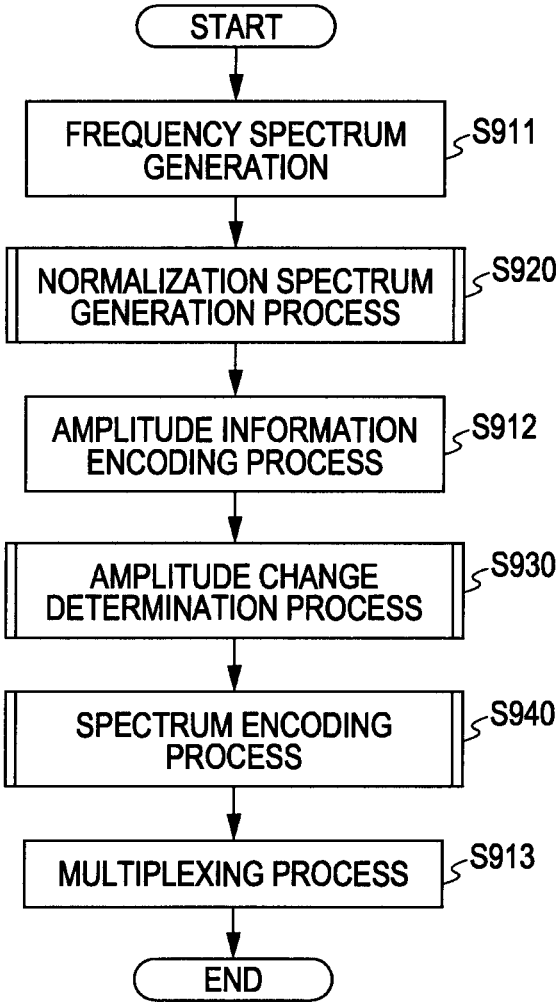
FIG. 8 is a flowchart illustrating an example of a procedure of an encoding method in the acoustic signal encoding apparatus according to the first embodiment of the invention.

FIG. 8 is a flowchart illustrating an example of a procedure of an encoding method in the acoustic signal encoding apparatus 200 according to the first embodiment of the invention.

First, in the frequency spectrum generation unit 210, the frequency spectrum is generated by converting the acoustic signal into frequency components (Step S911). Next, in the spectrum normalization unit 240, a normalization spectrum process for generating the normalization spectrum is performed based on the quantization amplitude information input from the quantization amplitude information calculation unit 230 and the frequency spectrum input from the frequency spectrum generation unit 210 (Step S920). Subsequently, in the amplitude reference value encoding unit 280, the amplitude reference value generated by the amplitude reference value generation unit 220 is encoded (Step S912).

Next, in the amplitude change amount calculation unit 260, an amplitude change determination process is performed based on the amplitude change amount calculated from the amplitude reference value with respect to each subband (Step S930). Next, in the spectrum encoding process unit 300, an encoding process is performed according to the occurrence probability distribution of the quantization value in the amplitude change amount with respect to each subband (Step S940). Next, in the multiplexing unit 290, the amplitude reference value encoded in the amplitude information encoding process and the encoding data generated in the spectrum encoding process are multiplexed (Step S913), and the procedure of the encoding process method is ended.

[Example of Procedure of Normalization Spectrum Generation Process]

Figure 9:
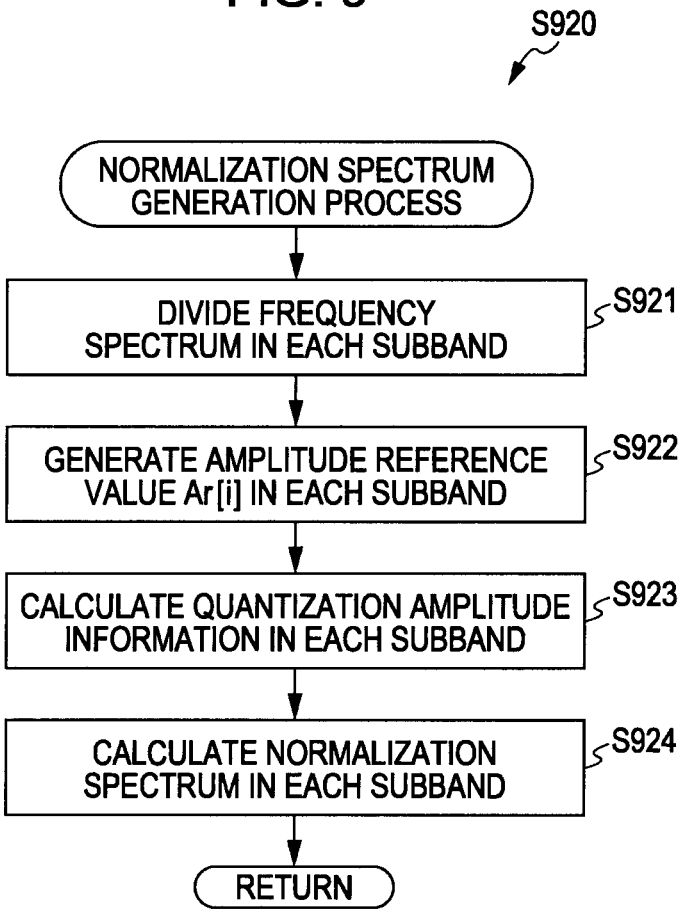
FIG. 9 is a flowchart illustrating an example of a procedure of a normalization spectrum generation process (Step S920) in the acoustic signal encoding apparatus according to the first embodiment of the invention.

FIG. 9 is a flowchart illustrating an example of a procedure of a normalization spectrum generation process (Step S920) in the acoustic signal encoding apparatus 200 according to the first embodiment of the invention.

First, in the amplitude reference value generation unit 220, the frequency spectrum generated by the frequency spectrum generation unit 210 is frequency-divided, so that the frequency components are extracted into predetermined subbands (Step S921). Next, in the amplitude reference value generation unit 220, the amplitude reference value Ar[i] with respect to each subband is generated based on the maximum level of the frequency components in each of the subbands (Step S922).

Next, in the quantization amplitude information calculation unit 230, the quantization amplitude information with respect to each subband is calculated in each subband based on the amplitude reference value with respect to the subband (Step S923). Subsequently, in the spectrum normalization unit 240, the frequency components corresponding to each subband are normalized in each subband based on the quantization amplitude information corresponding to the subband, so that the normalization spectrum is generated (Step S924), and the normalization spectrum generation process is ended.

[Example of Procedure of Amplitude Change Determination Process]

Figure 10:
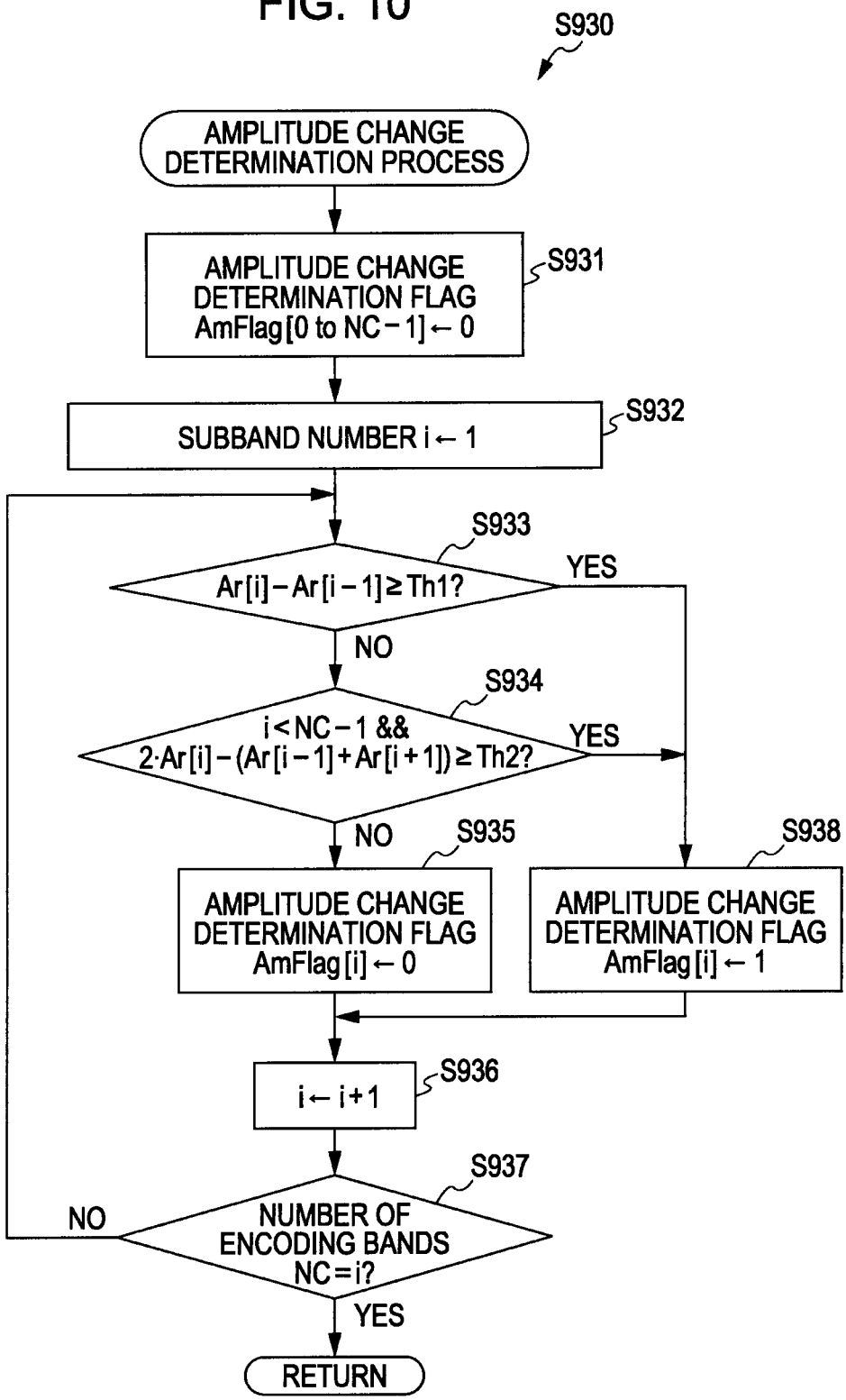
FIG. 10 is a flowchart illustrating an example of a procedure of an amplitude change determination process (Step S930) in the amplitude change amount calculation unit according to the first embodiment of the invention.

FIG. 10 is a flowchart illustrating an example of a procedure of an amplitude change determination process (Step S930) in the amplitude change amount calculation unit 260 according to the first embodiment of the invention.

First, the amplitude change determination flags AmFlag[0] to [NC−1] are set to "0" based on the number of encoding bands NC input from the encoding band setting unit (Step S931). Next, the subband number i is set to "1", so that the first subband is set as the to-be-determined subband (Step S932). By the processes of the Steps S931 and S932, an initialization of the amplitude change determination process is ended.

Next, it is determined based on the upper conditional equation of Equation 4 whether or not a subtraction value obtained by subtracting the amplitude reference value Ar[0] with respect to the zeroth subband adjacent to the low band side from the amplitude reference value Ar[1] with respect to the first subband is equal to or larger than the first change amount threshold value Th1 (Step S933). Next, in the case where the subtraction value is equal to or larger than the first change amount threshold value Th1, the first subband is determined to be a subband having a large amplitude change amount, so that the amplitude change determination flag AmFlag[1] with respect to the first subband is set to "1" (Step S938).

On the other hand, in the case where the subtraction value is smaller than the first change amount threshold value Th1, it is determined whether or not the lower conditional equation of Equation 4 is satisfied (Step S934). In other words, it is determined whether or not the subband number "i=1" is smaller than the maximum subband number (NC−1), and it is determined whether or not a value obtained by subtracting a sum of the amplitude reference values Ar[0] and Ar[2] from a product of the amplitude reference value Ar[1] and "2" is equal to or larger than the second change amount threshold value Th2.

Next, in the case where the lower conditional equation of Equation 4 is satisfied, it is determined that the first subband is a subband having a large amplitude change amount, so that the amplitude change determination flag AmFlag[1] with respect to the first subband is set to "1" (Step S938). On the other hand, in the case where the lower conditional equation of Equation 4 is not satisfied, it is determined that the first subband is not a subband having a large amplitude change amount, so that amplitude change determination flag AmFlag [1] with respect to the first subband is set to "0" (Step S935).

In this manner, by the processes of the Steps S933 and S934, the amplitude change amount is calculated based on the spectrum envelope by using the amplitude reference value of each subband with respect to the frequency spectrum in the input signal. In addition, the Steps S933 and S934 are an example of an amplitude change amount calculation procedure disclosed in the Claims.

Next, in order to increase the subband number by "1", the value "2" obtained by adding "1" to the subband number "1" is set to the subband number i (Step S936). Next, it is determined whether or not the subband number i is equal to the number of encoding bands NC (Step S937). Next, in the case where the subband number i is not equal to the number of encoding bands NC, a series of the processes of the Steps S933 to S936 and S938 repeats until the subband number i is equal to the number of encoding bands NC. On the other hand, in the case where the subband number i is equal to the number of encoding bands NC, the amplitude change determination process is ended.

[Example of Procedure of Spectrum Encoding Process]

Figure 11:
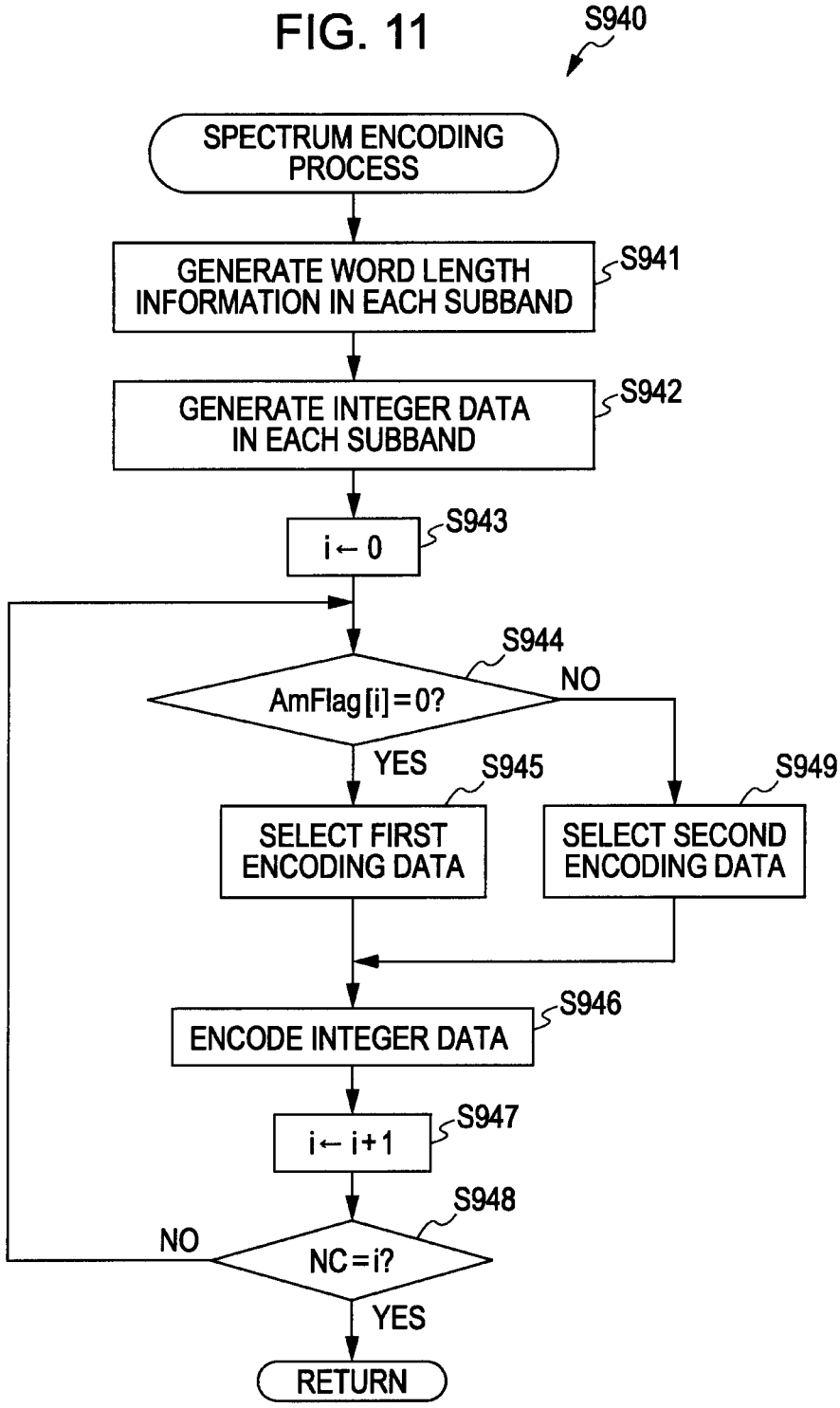
FIG. 11 is a flowchart illustrating an example of a procedure of a spectrum encoding process (Step S940) in the spectrum encoding process unit according to the first embodiment of the invention.

FIG. 11 is a flowchart illustrating an example of a procedure of a spectrum encoding process (Step S940) in the spectrum encoding process unit 300 according to the first embodiment of the invention.

First, in the word length information generation unit 250, the word length information with respect to each subband is generated based on the amplitude reference value of each subband generated in the process of the Step S922 (Step S941). Next, in the integer data generation unit 310, the integer data in each subband is generated by converting the normalization spectrum generated in the process of the Step S924 based on the word length information with respect to each subband (Step S942).

Next, the subband number i is set to "0" (Step S943). Subsequently, in the encoding selection unit 330, it is determined whether or not the amplitude change determination flag AmFlag[0] with respect to the zeroth subband is "0" (Step S944).

Next, in the case where the amplitude change determination flag AmFlag[0] is "0", since the subband is a subband having a small amplitude change amount, in the encoding selection unit 330, the encode list stored in the first encode table 340 is selected (Step S945). In other words, in the encoding selection unit 330, the encode list for encoding the integer data which is a quantization value of which the degree of deflection of the occurrence probability distribution is small is selected as the output of the first encode table 340.

On the other hand, in the case where the amplitude change determination flag AmFlag[0] is "1", since the subband is a subband having a large amplitude change amount, in the encoding selection unit 330, the encode list stored in the second encode table 350 is selected (Step S949). In other words, in the encoding selection unit 330, the encode list for encoding the integer data which is a quantization value of which the degree of deflection of the occurrence probability distribution is large is selected as the output of the second encode table 350.

In this manner, in the processes of the Steps S944, S945, and S949, among the plurality of the encoding algorithms, an encoding algorithm is selected according to the degree of deflection of the occurrence probability distribution of the quantization value in the amplitude change amount. In addition, the Steps S944, S945, and S949 are an example of an encoding selection procedure disclosed in the Claims.

Next, in the encoding unit 320, the integer data corresponding to the zeroth subband is encoded based on the encode list stored in the first or second encode table selected by the encoding selection unit 330 (Step S946). Accordingly, the encoding data corresponding to the zeroth subband is generated. In other words, the quantization value of the frequency spectrum is encoded through the encoding algorithm selected by the encoding selection unit 330. In addition, the Step S946 is an example of an encoding procedure disclosed in the Claims.

Next, in order to increase the subband number by "1", the value "1" obtained by adding "1" to the subband number "0" is set to the subband number i (Step S947). Next, it is determined whether or not the subband number i is equal to the number of encoding bands NC (Step S948). Next, in the case where the subband number i is not equal to the number of encoding bands NC, a series of the processes of the Steps S944 to S947 and S949 repeats until the subband number i is equal to the number of encoding bands NC. On the other hand, in the case where the subband number i is equal to the number of encoding bands NC, the spectrum encoding process is ended.

In this manner, in the first embodiment of the invention, in the amplitude change amount calculation unit 260, the amplitude change amount of each subband is calculated based on the amplitude reference values of the adjacent subbands, so that it is possible to determine the subband where the amplitude reference value exceeds a predetermined magnitude in comparison with the adjacent subbands. Accordingly, the acoustic signal encoding apparatus 200 may improve the encoding efficiency by performing the encoding according to the degree of deflection of the occurrence probability distribution of the quantization value in each subband.

2. Second Embodiment

[Example of Configuration of Acoustic Signal Decoding Apparatus 400]

Figure 12:
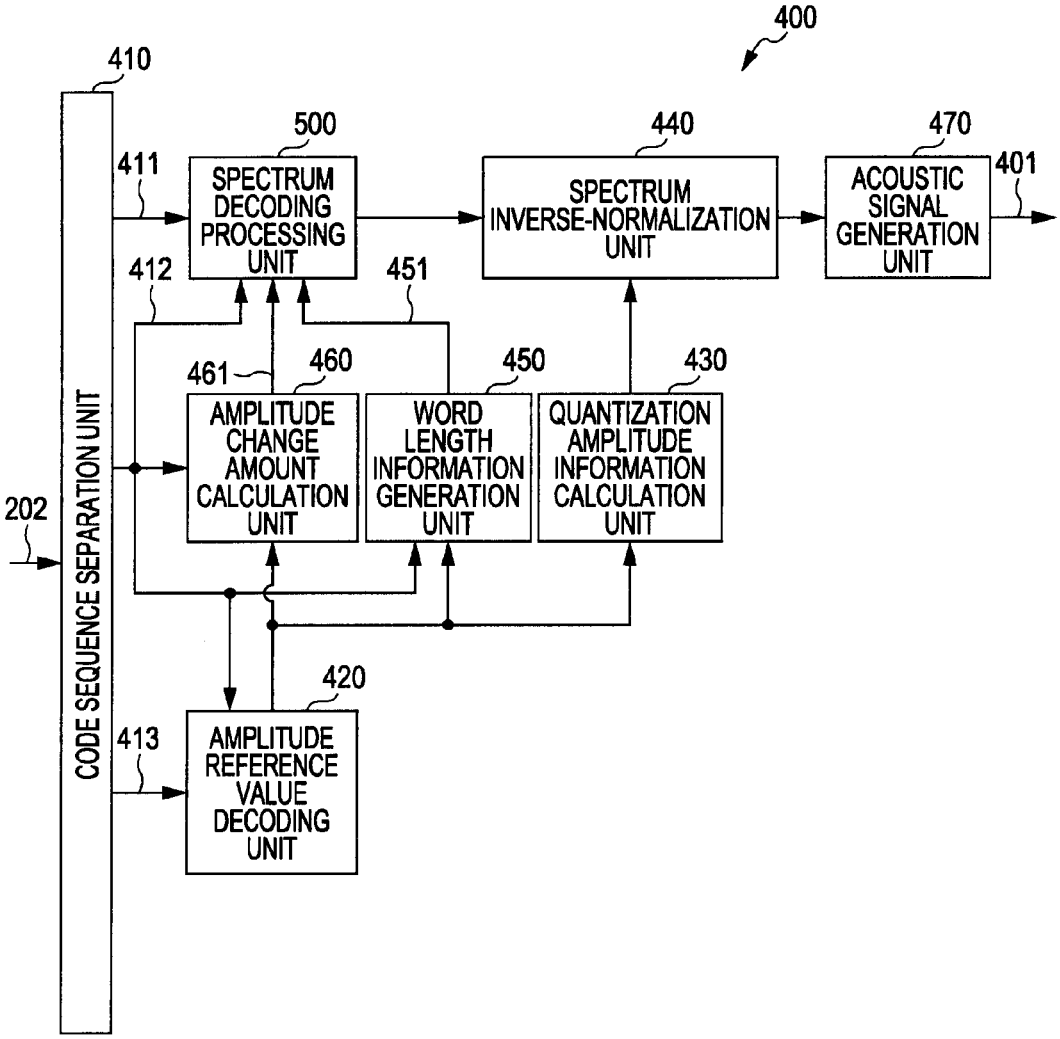
FIG. 12 is a block diagram illustrating an example of a configuration of an acoustic signal decoding apparatus according to a second embodiment of the invention.

FIG. 12 is a block diagram illustrating an example of a configuration of an acoustic signal decoding apparatus 400 according to a second embodiment of the invention.

The acoustic signal decoding apparatus 400 includes a code sequence separation unit 410, an amplitude reference value decoding unit 420, an amplitude change amount calculation unit 460, a word length information generation unit 450, and a spectrum decoding process unit 500. In addition, the acoustic signal decoding apparatus 400 further includes a quantization amplitude information calculation unit 430, a spectrum inverse normalization unit 440, and an acoustic signal generation unit 470.

The code sequence separation unit 410 separates acoustic encoding data, which is a code sequence supplied from the code sequence input line 202, into encoding data, an encoded amplitude reference value, and a number of encoding bands. The code sequence separation unit 410 supplies the encoding data, in which the acoustic signal is encoded, through a signal line 411 to spectrum decoding process unit 500 with respect to each subband.

In addition, the code sequence separation unit 410 supplies the number of encoding bands indicating the upper limit of the subband through a signal line 412 to the spectrum decoding process unit 500, the amplitude reference value decoding unit 420, the amplitude change amount calculation unit 460, and the word length information generation unit 450. In addition, the code sequence separation unit 410 supplies the encoded amplitude reference value with respect to the subband through a signal line 413 to the amplitude reference value decoding unit 420.

The amplitude reference value decoding unit 420 decodes the encoded amplitude reference value of each subband, which is input from a signal line 413. The amplitude reference value decoding unit 420 supplies the decoded amplitude reference value of each subband to the amplitude change amount calculation unit 460, the word length information generation unit 450, and the quantization amplitude information calculation unit 430.

The amplitude change amount calculation unit 460 calculates the amplitude change amount with respect to the subband based on the amplitude reference value of each subband supplied from the amplitude reference value decoding unit 420. The amplitude change amount calculation unit 460 corresponds to the amplitude change amount calculation unit 260 in the acoustic signal encoding apparatus 200 illustrated in FIG. 2. In other words, the amplitude change amount calculation unit 460 calculates the amplitude change amount with respect to each subband according to the same conditions as those of the amplitude change amount calculation unit 260 in the acoustic signal encoding apparatus 200.

The amplitude change amount calculation unit 460 calculates the amplitude change amount in each subband based on the amplitude reference value with respect to the change amount calculation band, that is, a predetermined subband, among the plurality of the subbands. The amplitude change amount calculation unit 460, for example, sets each subband adjacent to the subband, where the amplitude change amount is to be calculated, as a change amount calculation band and calculates the amplitude change amount with respect to the frequency spectrum based on each amplitude reference value with respect to the change amount calculation band. In this example, the amplitude change amount calculation unit 460 calculates the amplitude change amount with respect to the subband, for example, based on a difference in the amplitude reference value with respect to the adjacent subbands as the change amount calculation band.

In addition, since the amplitude change amount calculation unit 460 has the same functions as those of the amplitude change amount calculation unit 260 in the acoustic signal encoding apparatus 200, the description thereof is omitted. In addition, the amplitude change amount calculation unit 460 is an example of an amplitude change amount calculation unit in an acoustic signal decoding apparatus disclosed in the Claims.

The word length information generation unit 450 generates the word length information, which defines the quantization accuracy, in each subband based on the amplitude reference value corresponding to each subband, which is input from the amplitude reference value decoding unit 420. The word length information generation unit 450 has the same functions as those of the word length information generation unit 250 in the acoustic signal encoding apparatus 200 illustrated in FIG. 2. In other words, the word length information generation unit 450 generates the word length information with respect to each subband according to the same conditions as those of the word length information generation unit 250.

The word length information generation unit 450 generates the word length information with respect to each subband by performing, for example, a weighting operation on all the amplitude reference values by taking into consideration human auditory characteristics. In addition, the word length information generation unit 450 supplies the generated word length information through a signal line 451 to the spectrum decoding process unit 500.

The spectrum decoding process unit 500 decodes the encoding data, where the quantization value of the frequency spectrum in the input signal is encoded, through the plurality of the decoding algorithms. In addition, the spectrum decoding process unit 500 corresponds to the spectrum encoding process unit 300 illustrated in FIG. 2.

The spectrum decoding process unit 500 decodes the encoding data input from the code sequence separation unit 410 based on the word length information of each subband input from the word length information generation unit 450, the amplitude change determination flag input from the amplitude change amount calculation unit 460, and the number of encoding bands input from the code sequence separation unit 410.

The spectrum decoding process unit 500 selects one decoding algorithm from the plurality of the decoding algorithms based on the amplitude change determination flag input from the amplitude change amount calculation unit 460. In addition, the spectrum decoding process unit 500 generates the integer data that is a quantization value by decoding the encoding data through the selected decoding algorithm.

In addition, the spectrum decoding process unit 500 generated the normalization spectrum by converting the integer data in the subband based on the word length information input from the word length information generation unit 450. In addition, the spectrum decoding process unit 500 supplies the generated normalization spectrum to the spectrum inverse normalization unit 440.

The quantization amplitude information calculation unit 430 calculates the quantization amplitude information for converting the normalization spectrum into the frequency spectrum based on the amplitude reference value supplied from the amplitude reference value decoding unit 420. The quantization amplitude information calculation unit 430 has the same functions as those of the quantization amplitude information calculation unit 230 in the acoustic signal encoding apparatus 200 illustrated in FIG. 2. In other words, the quantization amplitude information calculation unit 430 calculates the quantization amplitude information with respect to each subband according to the same conditions as those of the quantization amplitude information calculation unit 230 in the acoustic signal encoding apparatus 200.

The quantization amplitude information calculation unit 430 calculates the quantization amplitude information $A^{(q)}i$ with respect to each subband based on, for example, Equation 2. In addition, the quantization amplitude information calculation unit 230 supplies the quantization amplitude information $A^{(q)}i$, which is calculated based on Equation 3, with respect to each subband to the spectrum inverse normalization unit 440.

The spectrum inverse normalization unit 440 generates the frequency spectrum by perform inverse normalization on the normalization spectrum input from the spectrum decoding process unit 500 based on the quantization amplitude information input from the quantization amplitude information calculation unit 430. For example, the spectrum inverse normalization unit 440 calculates the level X'[m] of the frequency spectrum by multiplying the quantization amplitude information $A^{(q)}i$ with respect to the i-th subband and the level N'[m] of the normalization spectrum corresponding to the i-th subband by using the following equation.

$$X'[m]=A^{(q)}{}_i \cdot N'[m] (m_i \leq m < m_{i+1}) \quad \text{[Equation 7]}$$

In addition, the spectrum inverse normalization unit 440 supplies the frequency spectrum X'[m], which is calculated based on the above equation, to the acoustic signal generation unit 470 in each subband.

The acoustic signal generation unit 470 generates the acoustic signal by converting a frequency-domain data, which is the frequency spectrum in all the frequency bands supplied from the spectrum inverse normalization unit 440, into a time-domain signal.

The acoustic signal generation unit 470 generates, for example, the acoustic signal in units of a frame by performing a fast Fourier transform on the frequency spectrum. As an alternative example, the acoustic signal generation unit 470 may generate the acoustic signal in units of a frame by performing an inverse modified discrete cosine transform. In addition, the acoustic signal generation unit 470 supplies the generated acoustic signal to an acoustic signal output line 401. In other words, the acoustic signal generation unit 470 supplies the acoustic signal through the acoustic signal output line 401 to the speaker 600.

In this manner, the acoustic signal decoding apparatus 400 is provided with the amplitude change amount calculation unit 460 of which the configuration is the same as that of the amplitude change amount calculation unit 260 in the acoustic signal encoding apparatus 200, so that it is possible to implement a decoding process corresponding to the spectrum encoding process unit 300 based on the amplitude reference value. Now, an example of a configuration of the spectrum decoding process unit 500 corresponding to the spectrum encoding process unit 300 illustrated in FIG. 7 is described with reference to the drawings.

[Example of Configuration of Spectrum Decoding Process Unit 500]

Figure 13:
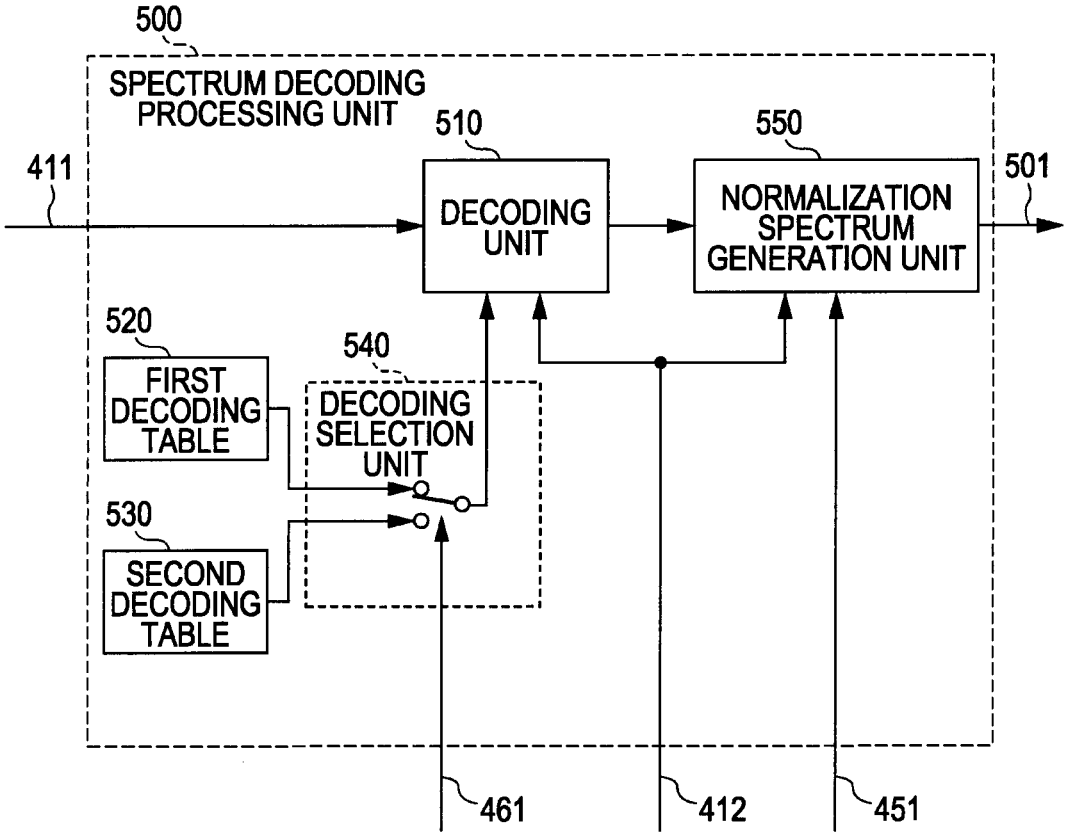
FIG. 13 is a block diagram illustrating an example of a configuration of a spectrum decoding process unit according to the second embodiment of the invention.

FIG. 13 is a block diagram illustrating an example of a configuration of the spectrum decoding process unit 500 according to the second embodiment of the invention. The spectrum decoding process unit 500 includes a decoding unit 510, first and second decode tables 520 and 530, a decoding selection unit 540, and a normalization spectrum generation unit 550.

The decoding unit 510 decodes the encoding data, where the quantization value of the frequency spectrum of the input signal is encoded, by using a plurality of decoding algorithms. The decoding unit 510 decodes the encoding data supplied through the signal line 411 from the code sequence separation unit 410 by referring to the encode list stored in one of the first and second decode tables 520 and 530. In other words, the decoding unit 510 decodes the encoding data according to one of the two decoding algorithms.

In addition, the decoding unit 510 decodes the to-be-decoded encoding data corresponding to the subband specified by the number of encoding bands supplied through a signal line 412 to the code sequence separation unit 410. In addition, the decoding unit 510 supplies the decoded encoding data as an integer data that is a quantization value to the normalization spectrum generation unit 550. In addition, the decoding unit 510 is an example of a decoding unit disclosed in the Claims.

The first and second decode tables 520 and 530 are decode tables which store the encode lists previously generated through the Huffman encoding as the decode lists. The first and second decode tables 520 and 530 correspond to the first and second encode tables 340 and 350 illustrated in FIG. 7. In other words, the first and second decode tables 520 and 530 store the same encode lists as those stored in the first and second encode tables 340 and 350 as the decode lists.

The first decode table 520 stores the decode list corresponding to the encode list for encoding the integer data that is a quantization value of which the degree of deflection of the occurrence probability distribution in the subband is small. In addition, the first decode table 530 outputs the stored decode list to the decoding selection unit 540.

The second decode table 530 stores the decode list corresponding to the encode list for encoding the integer data that is a quantization value of which the degree of deflection of the occurrence probability distribution in the subband is large. In addition, the second decode table 530 outputs the stored decode list to the decoding selection unit 540.

The decoding selection unit 540 selects one of the outputs of the first and second decode tables 520 and 530 based on the amplitude change determination flag supplied through the signal line 461 from the amplitude change amount calculation unit 460. In the case where the amplitude change determination flag indicating that the amplitude change amount of the amplitude reference value with respect to the subband is large is supplied, the decoding selection unit 540 selects the decode list stored in the second decode table 530.

On the other hand, in the case where the amplitude change determination flag indicating that the amplitude change amount of the amplitude reference value with respect to the subband is small is supplied, the decoding selection unit 540 selects the decode list stored in the first decode table 520. In other words, the decoding selection unit 540 selects the decoding algorithm according to the degree of deflection of the occurrence probability distribution of the quantization value in the amplitude change amount among the plurality of the decoding algorithms.

More specifically, for example, in the case where amplitude change determination flag is set to "1", the decoding selection unit 540 selects a decode list stored in the second decode table 530. On the other hand, in the case where the amplitude change amount determination flag is set to "0", the decoding selection unit 540 selects a decode list stored in the first decode table 520.

In addition, the decoding selection unit 540 supplies a decode list, which is stored in the selected first or second decode table 520 or 530, to the decoding unit 510. In addition, the decoding selection unit 540 is an example of a decoding selection unit disclosed in the Claims.

The normalization spectrum generation unit 550 generates the normalization spectrum by converting the integer data, which is a quantization value supplied from the decoding unit 510, in each subband based on the word length information supplied through a signal line 451. The normalization spectrum generation unit 550 converts the integer data into the normalization spectrum in each subband by using a predetermined function according to the same word length information as that for the encoding process.

The normalization spectrum generation unit 550 converts the integer data I[m] corresponding to the i-th subband into a normalization spectrum N'[m], for example, by a function $F_Q$ expressed in the following equation according to the word length information WL[i] corresponding to the i-th subband. In this example, the word length information WL[i] is set to the number of non-encoding quantization bits.

$$N'[m]=F_Q(I[m],WL[i]) \quad \text{[Equation 8]}$$

In the above equation, the function $F_Q$ corresponding to the function $F_I$ expressed in Equation 6 may be expressed, for example, by the following equation.

$$F_Q(I[m],WL[i])=I[m]\cdot(2^{WL[i]}-0.5)^{-1} \quad \text{[Equation 9]}$$

By Equations 8 and 9, the normalization spectrum N'[m] having a range of "1" to "−1" is converted into the integer data I[m], which is a quantization value, based on word length information WL[i]. For example, in the case where the word length information WL[i] indicates "2", the integer data I[m] having a range of "−3" to "3" corresponding to the i-th subband is converted into the normalization spectrum N'[m].

In addition, the normalization spectrum generation unit 550 converts the integer data, which is limited to the integer data corresponding to the to-be-encoded subband specified by the number of encoding bands supplied through a signal line 412 to the code sequence separation unit 410, into the normalization spectrum. In addition, the normalization spectrum generation unit 550 supplies the converted normalization spectrum through a signal line 501 to the spectrum inverse normalization unit 440 in each subband.

In this manner, the first and second decode tables 520 and 530 corresponding to the first and second encode tables 340 and 350 are provided, so that it is possible to decode the encoding data generated by the acoustic signal encoding apparatus 200. In addition, the decoding selection unit 540 is provided, so that the first and second decode tables 520 and 530 may be selected similarly to the encoding selection unit 330 in the acoustic signal encoding apparatus 200. Therefore, it is possible to perform an appropriate decoding process.

In addition, since the decoding algorithm is selected based on the amplitude reference value, the acoustic signal decoding apparatus 400 may appropriately decode the encoding data without multiplexing additional information on the encoding applied to each subband to the code sequence in the acoustic signal encoding apparatus 200. Therefore, since the additional information on the encoding may not have to be multiplexed in each subband, it is possible to improve the compression rate of the acoustic encoding data generated by the acoustic signal encoding apparatus 200.

[Example of Improvement of Compression Rate]

FIG. 14 is a diagram illustrating a result of comparison of a compression rate of integer data in the acoustic signal processing system 100 and a compression rate of integer data in a system of the related art. In the figure, with respect to sound sources 121, compression rates 122 of a system of the related art and the acoustic signal processing system 100 and compression rate differences 123 are illustrated.

In the sound sources 121, as items for compression rate comparison, general music pieces 1 and 2, keyboard instruments 1 and 2, percussion instruments 1 and 2, wind instruments 1 and 2, and classical music piece are illustrated.

In the compression rate 122, the compression rates of the system of the related art and the compression rates of the acoustic signal processing system 100 are illustrated. With respect to the compression rates 122 of the system of the related art and the acoustic signal processing system 100, the smaller the value thereof is, the higher the efficiency of the compression is. The compression rate 122 of the system of the related art denotes a ratio of the acoustic encoding data per second generated by one Huffman encode table to the acoustic encoding data per second generated through fixed length encoding.

In addition, the compression rate of the acoustic signal processing system 100 denotes a ratio of the acoustic encoding data per second generated by the acoustic signal processing system 100 to the acoustic encoding data per second generated through the fixed length encoding. In other words, the compression rate of the acoustic signal processing system 100 denotes a ratio of the acoustic encoding data generated by switching the two encode tables, that is, the first and second encode tables 340 and 350 to the acoustic encoding data generated through the fixed length encoding.

In the compression rate difference 123, values obtained by subtracting the compression rates of the system of the related art from the compression rates of the acoustic signal processing system 100 are illustrated. With respect to the compression rate difference 123, as the value thereof is small, the compression rate of the acoustic signal processing system 100 is improved in comparison with the system of the related art.

In this manner, in comparison with the compression rate 122 of the system of the related art, the compression rate of the acoustic signal processing system 100 is small with respect to any sound source 121. Therefore, it may be understood that the compression rate of the acoustic encoding data generated by the acoustic signal encoding apparatus 200 is improved in comparison with the system of the related art. This is because it is possible to improve the encoding efficiency by selecting the encode table according to the degree of deflection of the occurrence probability distribution of the quantization value in the amplitude change amount calculated based on the amplitude reference value of each subband and because the additional information on the encoding is unnecessary unlike the system of the related art.

In addition, since the compression rate differences 123 corresponding to percussion instruments 1 and 2 and wind instruments 1 and 2 are relatively small, it is considered that the compression rate is improved with respect to the acoustic signal as the change in the amplitude level on the frequency axis becomes large.

[Example of Operations of Acoustic Signal Decoding Apparatus 400]

Now, operations of the acoustic signal encoding apparatus 200 according to the second embodiment are described with reference to the drawings.

Figure 15:
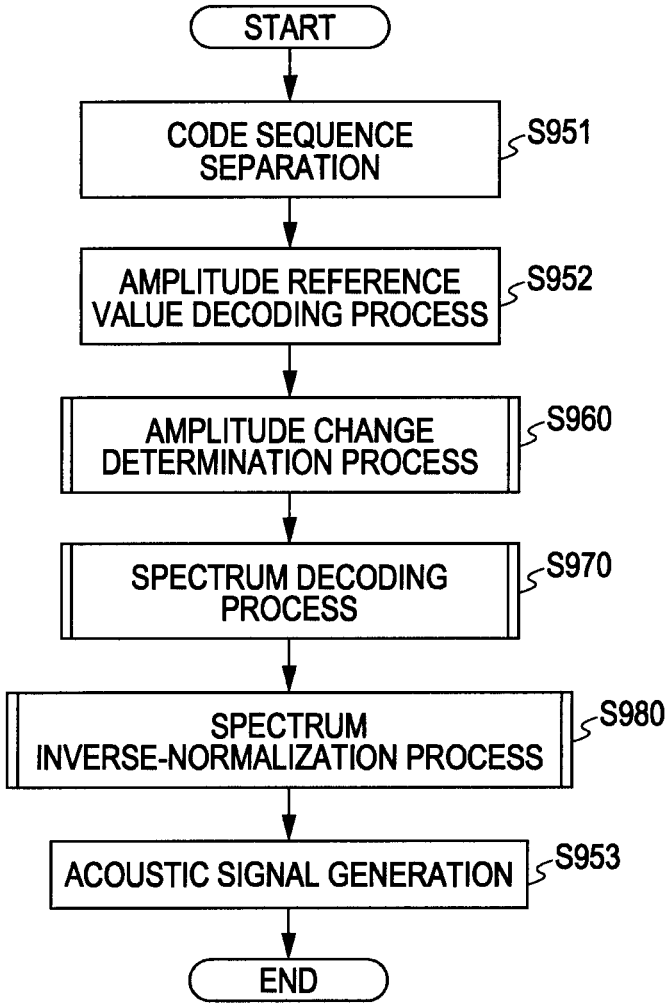
FIG. 15 is a flowchart illustrating an example of a procedure of a decoding method in the acoustic signal encoding apparatus according to the second embodiment of the invention.

FIG. 15 is a flowchart illustrating an example of a procedure of a decoding method in the acoustic signal encoding apparatus 200 according to the second embodiment of the invention.

First, in the code sequence separation unit 410, the code sequence input from the code sequence input line 202 is separated into an encoding data, an encoded amplitude reference value, and a number of encoding bands (Step S951). Subsequently, in the amplitude reference value decoding unit 420, the encoded amplitude reference value input from the code sequence separation unit 410 is decoded (Step S952).

Next, in the amplitude change amount calculation unit 460, an amplitude change determination process for generating the amplitude change determination flag is performed based on the amplitude reference value in each subband input from the amplitude reference value decoding unit 420 (Step S960). Next, in the spectrum decoding process unit 500, a spectrum decoding process is performed in each subband on the encoding data input from the code sequence separation unit 410 based on the amplitude change determination flag generated in the amplitude change determination process (Step S970).

Subsequently, in the spectrum inverse normalization unit 440, a spectrum inverse normalization process is performed in each subband on the normalization spectrum generated in the spectrum decoding process (Step S980). Next, in the acoustic signal generation unit 470, the acoustic signal is generated based on the frequency spectrum generated in the spectrum inverse normalization process (Step S953), and the procedure of the decoding method is ended.

[Example of Amplitude Change Determination Process in Amplitude Change Amount Calculation Unit 460]

Figure 16:
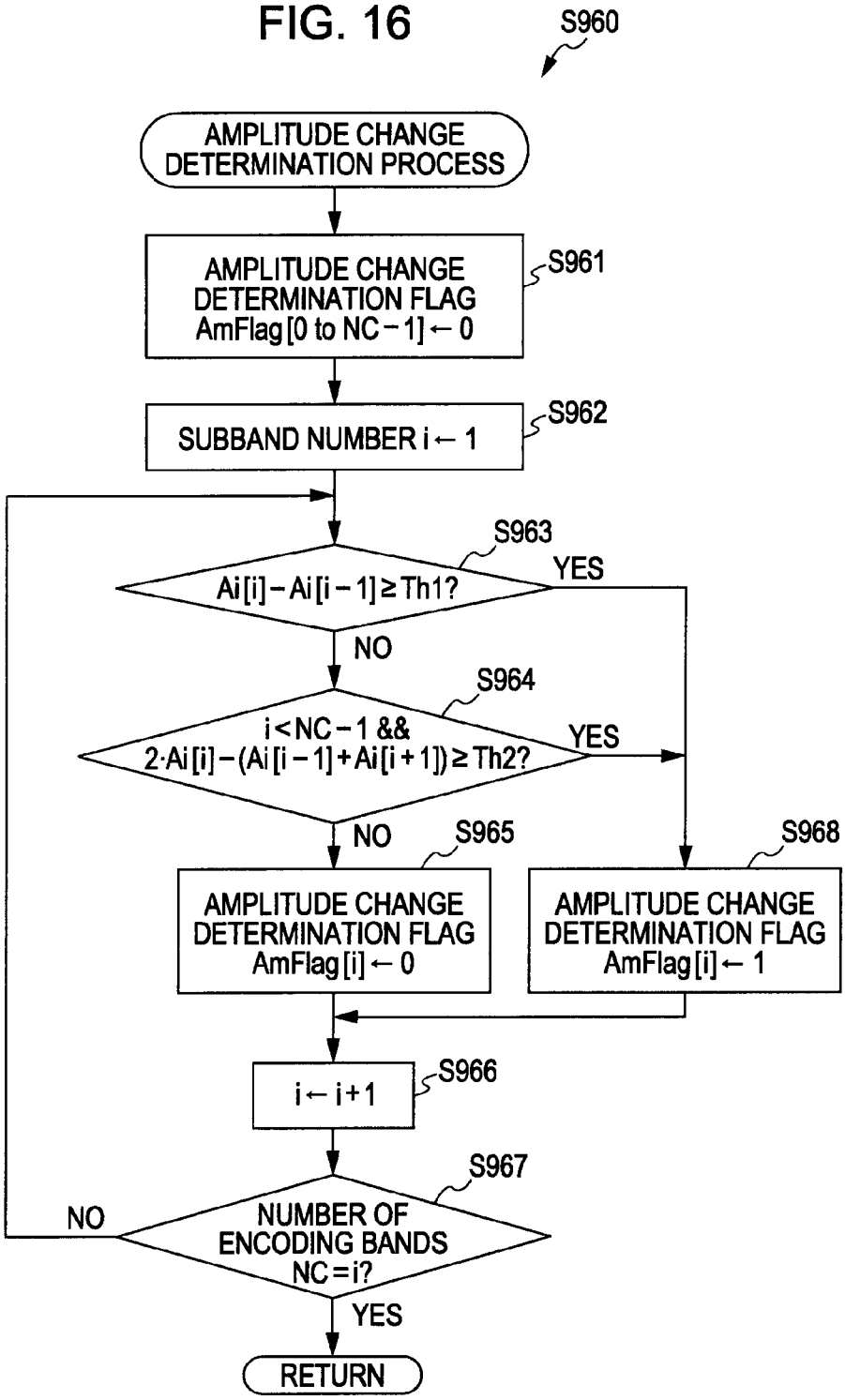
FIG. 16 is a flowchart illustrating an example of a procedure of an amplitude change determination process (Step S960) in the amplitude change amount calculation unit according to the second embodiment of the invention.

FIG. 16 is a flowchart illustrating an example of a procedure of the amplitude change determination process (Step S960) in the amplitude change amount calculation unit 460 according to the second embodiment of the invention. The amplitude change determination process (Step S960) corresponds to the amplitude determination process (Step S930) illustrated in FIG. 10.

First, the amplitude change determination flags AmFlag[0] to [NC−1] are set to "0" based on the number of encoding bands NC input from the code sequence separation unit 410 (Step S961). Next, the subband number i is set to "1" (Step S962). By the processes of the Steps S961 and S962, an initialization of the amplitude change determination process is ended.

Next, it is determined based on the upper conditional equation of Equation 4 whether or not a subtraction value obtained by subtracting the amplitude reference value Ar[0] with respect to the zeroth subband adjacent to the low band side from the amplitude reference value Ar[1] with respect to the first subband is equal to or larger than the first change amount threshold value Th1 (Step S963). Next, in the case where the subtraction value is equal to or larger than the first change amount threshold value Th1, the first subband is determined to be a subband having a large amplitude change amount, so that the amplitude change determination flag AmFlag[1] with respect to the first subband is set to "1" (Step S968).

On the other hand, in the case where the subtraction value is smaller than the first change amount threshold value Th1, it is determined whether or not the lower conditional equation of Equation 4 is satisfied (Step S964). In other words, it is determined whether or not the subband number "i=1" is smaller than the maximum subband number (NC−1), and it is determined whether or not a value obtained by subtracting a sum of the amplitude reference values Ar[0] and Ar[2] from a product of the amplitude reference value Ar[1] and "2" is equal to or larger than the second change amount threshold value Th2.

Next, in the case where the lower conditional equation of Equation 4 is satisfied, it is determined that the first subband is a subband having a large amplitude change amount, so that the amplitude change determination flag AmFlag[1] with respect to the first subband is set to "1" (Step S968). On the other hand, in the case where the lower conditional equation of Equation 4 is not satisfied, it is determined that the first subband is not a subband having a large amplitude change amount, so that amplitude change determination flag AmFlag [1] with respect to the first subband is set to "0" (Step S965).

In this manner, by the processes of the Steps S963 and S964, the amplitude change amount with respect to the subband is calculated based on the amplitude reference value of a predetermined subband among the amplitude reference values input from the acoustic signal encoding apparatus 200. In addition, the Steps S963 and S964 are an example of an amplitude change amount calculation procedure disclosed in the Claims.

Next, in order to increase the subband number by "1", the value "2" obtained by adding "1" to the subband number "1" is set to the subband number i (Step S966). Next, it is determined whether or not the subband number i is equal to the number of encoding bands NC (Step S967). Next, in the case where the subband number i is not equal to the number of encoding bands NC, a series of the processes of the Steps S963 to S966 and S968 repeats until the subband number i is equal to the number of encoding bands NC. On the other hand, in the case where the subband number i is equal to the number of encoding bands NC, the amplitude change determination process is ended.

[Example of Spectrum Decoding Process in Spectrum Decoding Process Unit 500]

Figure 17:
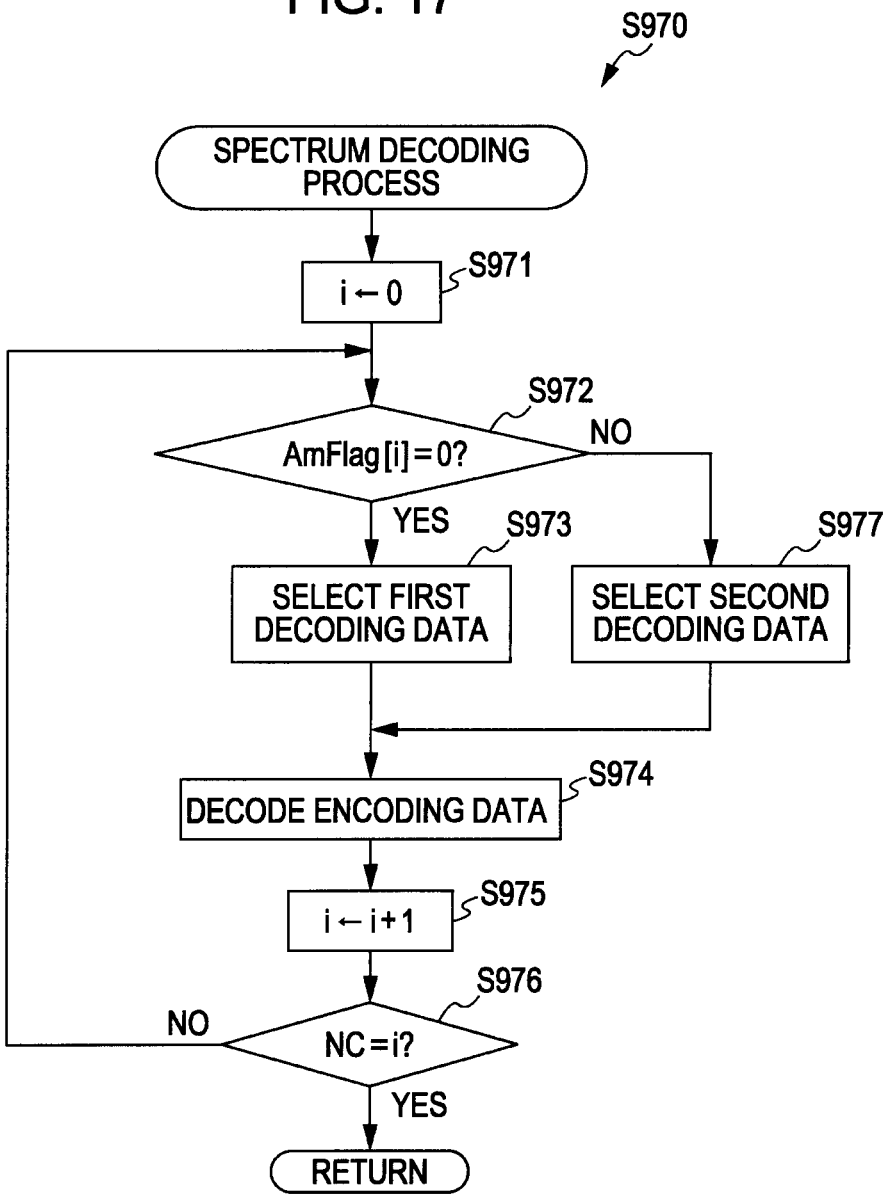
FIG. 17 is a flowchart illustrating an example of a procedure of a spectrum decoding process (Step S970) in the spectrum decoding process unit according to the second embodiment of the invention.

FIG. 17 is a flowchart illustrating an example of a procedure of the spectrum decoding process (Step S970) in the spectrum decoding process unit 500 according to the second embodiment of the invention.

First, for the initialization of the spectrum decoding process, the subband number i is set to "0" (Step S971). Subsequently, in the decoding selection unit 540, it is determined whether or not amplitude change determination flag AmFlag [0] with respect to the zeroth subband is "0" (Step S972).

Next, in the case where the amplitude change determination flag AmFlag[0] is "0", since the subband is a subband having a small amplitude change amount, in the decoding selection unit 540, the decode list stored in the first decode table 520 is selected (Step S973). In other words, in the decoding selection unit 540, the decode list corresponding to the encode list for encoding the integer data which is a quantization value of which the degree of deflection of the occurrence probability distribution is small is selected as the output of the first decode table 520.

On the other hand, in the case where the amplitude change determination flag AmFlag[0] is "1", since the subband is a subband having a large amplitude change amount, in the decoding selection unit 540, the decode list stored in the second decode table 530 is selected (Step S977). In other words, in the decoding selection unit 540, the decode list corresponding to the encode list for encoding the integer data which is a quantization value of which the degree of deflection of the occurrence probability distribution is large is selected as the output of the second decode table 530.

In this manner, in the processes of the Steps S972, S973, and S977, among the plurality of the decoding algorithms, a decoding algorithm is selected according to the degree of deflection of the occurrence probability distribution of the quantization value in the amplitude change amount. In addition, the Steps S972, S973, and S977 are an example of a decoding selection procedure disclosed in the Claims.

Next, in the decoding unit 510, the encoding data corresponding to the zeroth subband is decoded based on the decode list stored in the first or second decode table selected by the decoding selection unit 540 (Step S974). Accordingly, the integer data corresponding to the zeroth subband is generated. In other words, the encoding data is decoded through the decoding algorithm selected by the decoding selection unit 540. In addition, the Step S974 is an example of a decoding procedure disclosed in the Claims.

Next, in order to increase the subband number by "1", the value "1" obtained by adding "1" to the subband number "0" is set to the subband number i (Step S975). Next, it is determined whether or not the subband number i is equal to the number of encoding bands NC (Step S976). Next, in the case where the subband number i is not equal to the number of encoding bands NC, a series of the processes of the Steps S972 to S975 and S977 repeats until the subband number i is equal to the number of encoding bands NC. On the other hand, in the case where the subband number i is equal to the number of encoding bands NC, the spectrum decoding process is ended.

[Example of Procedure of Spectrum Inverse Normalization Process]

Figure 18:
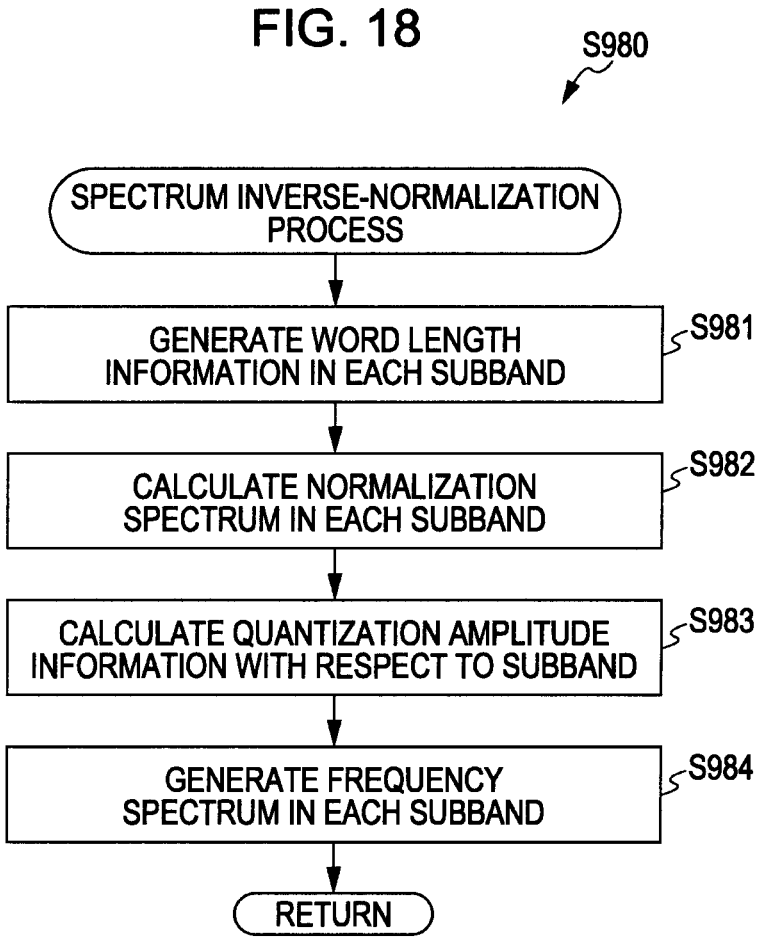
FIG. 18 is a flowchart illustrating an example of a procedure of an inverse normalization process (Step S980) in the acoustic signal decoding apparatus according to the second embodiment of the invention.

FIG. 18 is a flowchart illustrating an example of a procedure of the spectrum inverse normalization process (Step S980) in the acoustic signal decoding apparatus 400 according to the second embodiment of the invention.

First, in the word length information generation unit 450, the word length information with respect to each subband is generated based on the amplitude reference value of each subband generated in the process of the Step S952 (Step S981). Next, in the normalization spectrum generation unit 550, the normalization spectrum in each subband is generated by converting the integer data generated in the process of the Step S970 based on the word length information with respect to each subband (Step S982).

Next, in the quantization amplitude information calculation unit 430, the quantization amplitude information with respect to the subband is calculated in each subband based on the amplitude reference value with respect to the subband (Step S983). Subsequently, in the spectrum inverse normalization unit 440, the normalization spectrum corresponding to the subband is converted in each subband into the frequency spectrum based on the quantization amplitude information corresponding to the subband (Step S984), and the spectrum inverse normalization process is ended. In addition, all the frequency components in the subbands of which the number exceeds the number of encoding bands are set to "0".

In this manner, in the second embodiment of the invention, the same amplitude change amount calculation unit 460 as that of the acoustic signal encoding apparatus 200 is provided, so that it is possible to decode the encoding data, which is encoded by the acoustic signal encoding apparatus 200, based on the amplitude change amount with respect to each subband. In other words, the acoustic signal decoding apparatus 400 may appropriately decode the encoding data encoded according to the degree of deflection of the occurrence probability distribution of the quantization value in the amplitude change amount by the calculating the amplitude change amount based on the amplitude reference value of each subband.

In addition, in the first and second embodiments of the invention, although an example of determining the subband having a large amplitude change amount based on the conditional equations expressed in Equation 4 is described, the determination may be performed by using other conditional equations in order to specify the subband including pulse-like waveforms. The below-described third and fourth embodiments are the examples of determining the subband having a large amplitude change amount based on other conditional equations in addition to the conditional equations expressed in Equation 4.

3. Third Embodiment

[Example of Configuration of Acoustic Signal Encoding Apparatus 200]

Figure 19:
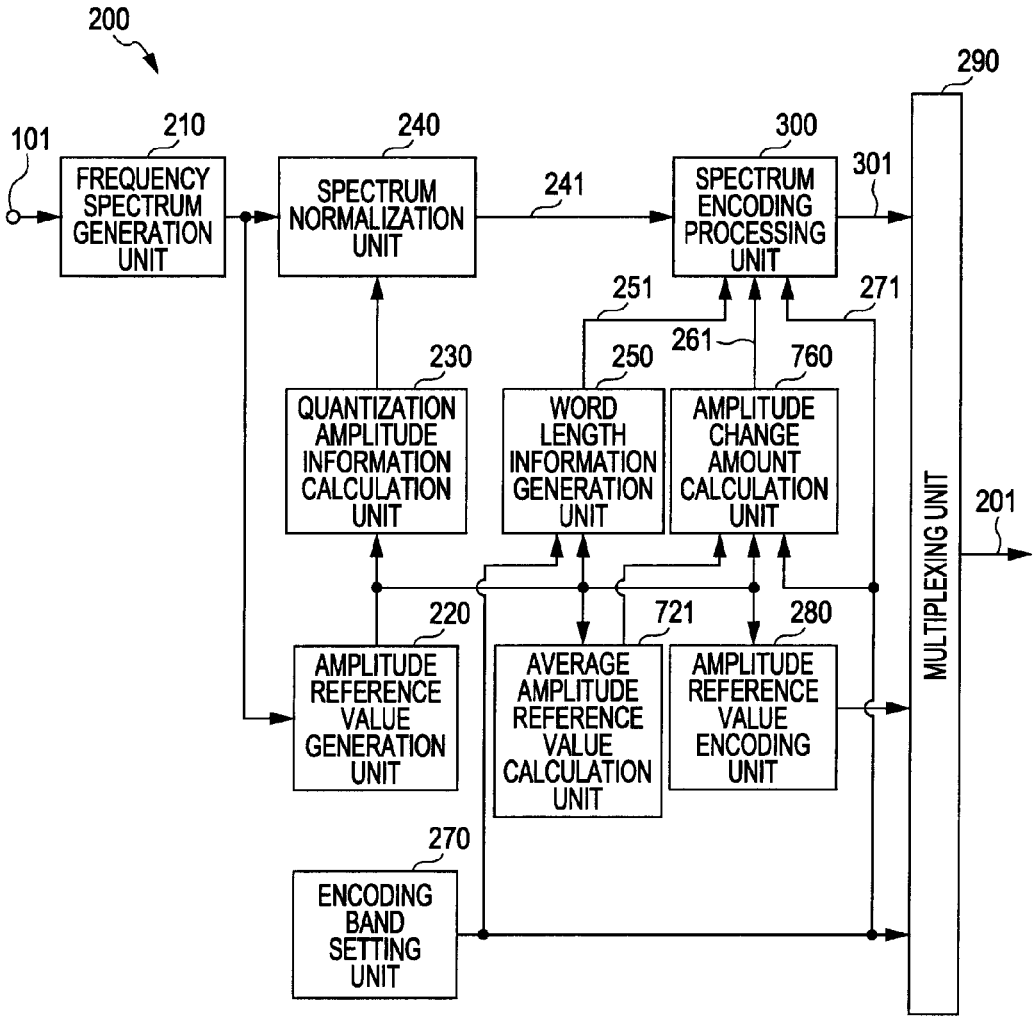
FIG. 19 is a block diagram illustrating an example of a configuration of an acoustic signal encoding apparatus 200 according to a third embodiment of the invention.

FIG. 19 is a block diagram illustrating an example of a configuration of an acoustic signal encoding apparatus 200 according to a third embodiment of the invention. The acoustic signal encoding apparatus 200 includes an average amplitude reference value calculation unit 721 and an amplitude change amount calculation unit 760 as a substitute for the configuration of the amplitude change amount calculation unit 260 in the acoustic signal encoding apparatus 200 illustrated in FIG. 2. In this embodiment, since other components except for the average amplitude reference value calculation unit 721 and the amplitude change amount calculation unit 760 are the same as those illustrated in FIG. 2, the description thereof is omitted.

The average amplitude reference value calculation unit 721 calculates an average value of the amplitude reference values of the subbands, which are generated by the amplitude reference value generation unit 220, as an average amplitude reference value. The average amplitude reference value calculation unit 721 calculates the average amplitude reference value with respect to the subband in the low band of, for example, 0 Hz to 3 KHz. Therefore, since the amplitude reference value with respect to the subband in the low band is set as an object of calculation, and since the amplitude reference value in the low band is larger than that in the high band as illustrated in FIGS. 3A and 3B, the average amplitude reference value calculation unit 721 may set the average amplitude reference value to a relatively large value.

The average amplitude reference value calculation unit 721 generates the average amplitude reference value Ar_ave based on, for example, the following equation.

$$\text{Ar_ave} = \sum_{i=SB}^{EB-1} Ar[i]/(EB-SB) \qquad \text{[Equation 10]}$$

In the above equation, SB is a starting band number indicating a subband number corresponding to the lowest subband among the subbands where the average amplitude reference value Ar_ave is to be calculated. In addition, EB is an ending band number indicating a value obtained by adding "1" to the subband number corresponding to the highest subband among the subbands where the average amplitude reference value Ar_ave is to be calculated.

In addition, for example, the average amplitude reference value calculation unit 721 may calculate the average amplitude reference value Ar_ave by performing multiplication of a value corresponding to "1/(EB−SB)" instead of division by "EB−SB" in Equation 10. Accordingly, it is possible to prevent an error from occurring in the division in the calculation process of Equation 10. In addition, the average amplitude reference value calculation unit 721 supplies the calculated average amplitude reference value Ar_ave to the amplitude change amount calculation unit 760.

The amplitude change amount calculation unit 760 calculates the amplitude change amount with respect to the frequency spectrum based on the amplitude reference value with respect to the each subband input from the amplitude reference value generation unit 220 and the average amplitude reference value input from the average amplitude reference value calculation unit 721. The amplitude change amount calculation unit 760 corresponds to the amplitude change amount calculation unit 260 illustrated in FIG. 2.

The amplitude change amount calculation unit 760 determines the subband having a large amplitude change amount of the amplitude reference value in comparison with the adjacent subbands based on the conditions expressed in the following equation in addition to the conditional equations of Equation 4.

$$\begin{cases} Ar[i] - \text{Ar_ave} \geq Th3 & (NS \leq i < NC) \\ Ar[i] - Ar[i-1] \geq Th4 \end{cases} \qquad \text{[Equation 11]}$$

In the above equation, Th3 and Th4 denote third and fourth change amount threshold values. The fourth change amount threshold value Th4 is set to a value that is smaller than the first change amount threshold value Th1 expressed in Equation 4. Accordingly, although a subband does not satisfy the conditional equations of Equation 4, a subband where the degree of deflection of the occurrence probability distribution of the quantization value is considered to be large may be specified.

In addition, NS expressed in Equation 11 is a starting number indicating a subband number corresponding to the subbands in the lowest band among the subbands. The starting number NS is set in this manner because the subbands in the low band have a small number of frequency spectrums and do not greatly contribute the improvement of the encoding efficiency. Therefore, since the subbands in the low band may be removed from the to-be-determined subbands, it is possible to reduce the number of calculation processes involved with the amplitude change determination process. In addition, in the upper conditional equation in Equation 11, the i-th subband corresponds to the change amount calculation band. In addition, in the lower conditional equation in Equation 11, the (i−1)-th and i-th subbands correspond to the change amount calculation bands.

The amplitude change amount calculation unit 760 calculates the amplitude change amount with respect to the i-th subband by subtracting the average amplitude reference value Ar_ave input from the average amplitude reference value calculation unit 721 from the amplitude reference value Ar[i] of the i-th subband by using the upper conditional equation of Equation 11. In other words, the amplitude change amount calculation unit 760 calculates the amplitude change amount in each subband based on the average value of the amplitude reference values with respect to the subbands in the low band and the amplitude reference value with respect to the change amount calculation band.

Next, the amplitude change amount calculation unit 760 determines whether or not the calculated amplitude change amount is equal to or larger than the third change amount threshold value Th3. In other words, the amplitude change amount calculation unit 760 determines based on the upper conditional equation of Equation 11 whether or not the subband indicates the amplitude reference value equal to or larger than the third change amount threshold value Th3 other than the average amplitude reference value Ar_ave.

In addition, the amplitude change amount calculation unit 760 calculates the amplitude change amount with respect to the i-th subband based on the difference between the amplitude reference value Ar[i] of the i-th subband and the amplitude reference value Ar[i−1]-th of the (i−1)-th subband adjacent to the low band side of the i-th subband by using the lower conditional equation of Equation 11. Next, the amplitude change amount calculation unit 260 determines whether or not the calculated amplitude change amount is equal to or larger than the fourth change amount threshold value Th4. In other words, the amplitude change amount calculation unit 760 determines based on the lower conditional equation of Equation 11 whether or not the amplitude reference value of the subband is equal to or larger than the fourth change amount threshold value Th4 in comparison with the amplitude reference value with respect to the subband adjacent to the low band side.

In addition, the amplitude change amount calculation unit 760 determines based on the two conditional equations expressed in Equation 11 that the subband satisfying the two conditional equations is a subband having a large amplitude change amount in comparison with the adjacent subbands. Therefore, although a subband does not satisfy the conditional equations of Equation 4, the amplitude change amount calculation unit 760 may determine the subband, where a difference in the amplitude level of the frequency components in the subband is considered to be large, as a subband having a large amplitude change amount.

In addition, since other function except for the aforementioned functions of the amplitude change amount calculation unit 760 are the same as those of the amplitude change amount calculation unit 260 illustrated in FIG. 2, the description thereof is omitted. In addition, amplitude change amount calculation unit 760 is an example of an amplitude change amount calculation unit disclosed in the Claims.

In this manner, the average amplitude reference value calculation unit 721 and the amplitude change amount calculation unit 760 are provided, so that it is possible to determine the subband having a large amplitude change amount based on the average value of the amplitude reference values with respect to the subbands in the low band. In other words, the amplitude change amount calculation unit 760 may determine the subband, where the degree of deflection of the occurrence probability distribution of the quantization value is large, based on the conditional equations of Equation 11.

[Example of Operations of Acoustic Signal Encoding Apparatus 200]

Now, operations of the acoustic signal encoding apparatus 200 according to the third embodiment are described with reference to the drawings. In the operations of the acoustic signal encoding apparatus 200, an amplitude determination process (Step S990) is performed as a substitute for the amplitude determination process (Step S930) in the acoustic signal encoding apparatus 200 illustrated in FIG. 9. Therefore, the amplitude determination process (Step S990) is described in brief with reference to the drawings, and the description of other processes which are the same as those illustrated in FIG. 9 is omitted.

Figure 20:
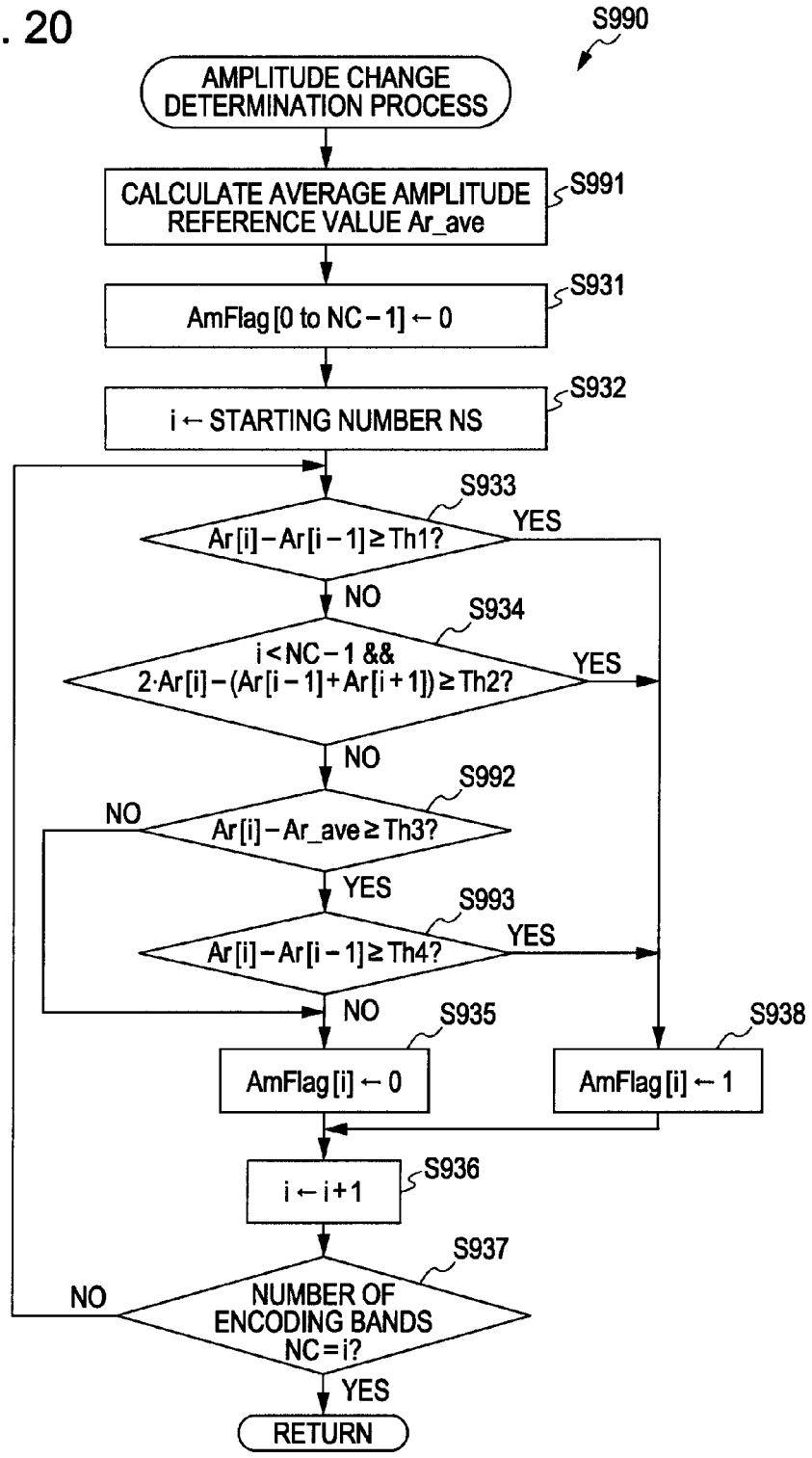
FIG. 20 is a flowchart illustrating an example of a procedure of an amplitude change determination process (Step S990) in the acoustic signal encoding apparatus 200 according to the third embodiment.

FIG. 20 is a flowchart illustrating an example of a procedure of the amplitude change determination process (Step S990) in the acoustic signal encoding apparatus 200 according to the third embodiment. In this example, since other processes except for the Steps S991, S992, and S993 are the same as those illustrated in FIG. 10, the description thereof is omitted.

First, in the average amplitude reference value calculation unit 721, the average amplitude reference value Ar_ave is calculated by calculating the average value of the amplitude reference value with respect to the subbands input from the amplitude reference value generation unit 220 (Step S991). For example, in the average amplitude reference value calculation unit 721, the average value of the amplitude reference values of the subbands corresponding to the low band is calculated as the average amplitude reference value.

In the case where the lower conditional equation of Equation 4 is not satisfied in the Step S934, in the amplitude change amount calculation unit 760, it is determined whether or not the upper conditional equation expressed in Equation 11 is satisfied. In other words, it is determined whether or not a subtraction value obtained by subtracting the average amplitude reference value Ar_ave calculated by the average amplitude reference value calculation unit 721 from the amplitude reference value Ar[i] with respect to the to-be-determined i-th subband is equal to or larger than the third change amount threshold value Th3 (Step S992).

Next, in the case where the subtraction value is smaller than the third change amount threshold value Th3, the procedure proceeds to the Step S935, in which the subband is determined to be a subband having an amplitude change amount. Next, the amplitude change determination flag AmFlag[i] with respect to the i-th subband is set to "0" (Step S935). On the other hand, in the case where the subtraction value is equal to or larger than the third change amount threshold value Th3, in the amplitude change amount calculation unit 760, it is determined whether or not the lower conditional equation of Equation 11 is satisfied. In other words, it is determined whether or not a subtraction value obtained by subtracting the amplitude reference value Ar[i−1] with respect to the (i−1)-th subband adjacent to the low band side from the amplitude reference value Ar[i] with respect to the i-th subband is equal to or larger than the fourth change amount threshold value Th4 (Step S993).

Next, in the case where the subtraction value is equal to or larger than the fourth change amount threshold value Th4, the i-th subband is determined to be a subband having an amplitude change amount, and the amplitude change determination flag AmFlag[i] with respect to the i-th subband is set to "1" (Step S938). On the other hand, in the case where the lower conditional equation of Equation 11 is not satisfied, the subband is determined not to be a subband having an amplitude change amount, and the amplitude change determination flag AmFlag[i] with respect to the i-th subband is set to "0" (Step S935).

In this manner, in the processes of the Steps S933, S934, S992, and S993, the amplitude change amount is calculated based on the spectrum envelope by using the amplitude reference value of each subband with respect to the frequency spectrum in the input signal. In addition, the Steps S933, S934, S992, and S993 are an example of an amplitude change amount calculation procedure disclosed in the Claims.

In this manner, according to the third embodiment of the invention, it is possible to determine the subband where the degree of deflection of the occurrence probability distribution of the quantization value is large, by using the conditional equations of Equation 11 among the subbands where the amplitude change amount is determined to be small by the amplitude change amount calculation unit 260 in the first embodiment. Next, an acoustic signal decoding apparatus corresponding to the acoustic signal encoding apparatus 200 according to the third embodiment of the invention is described as a fourth embodiment in brief with reference to the drawings.

4. Fourth Embodiment

Figure 21:
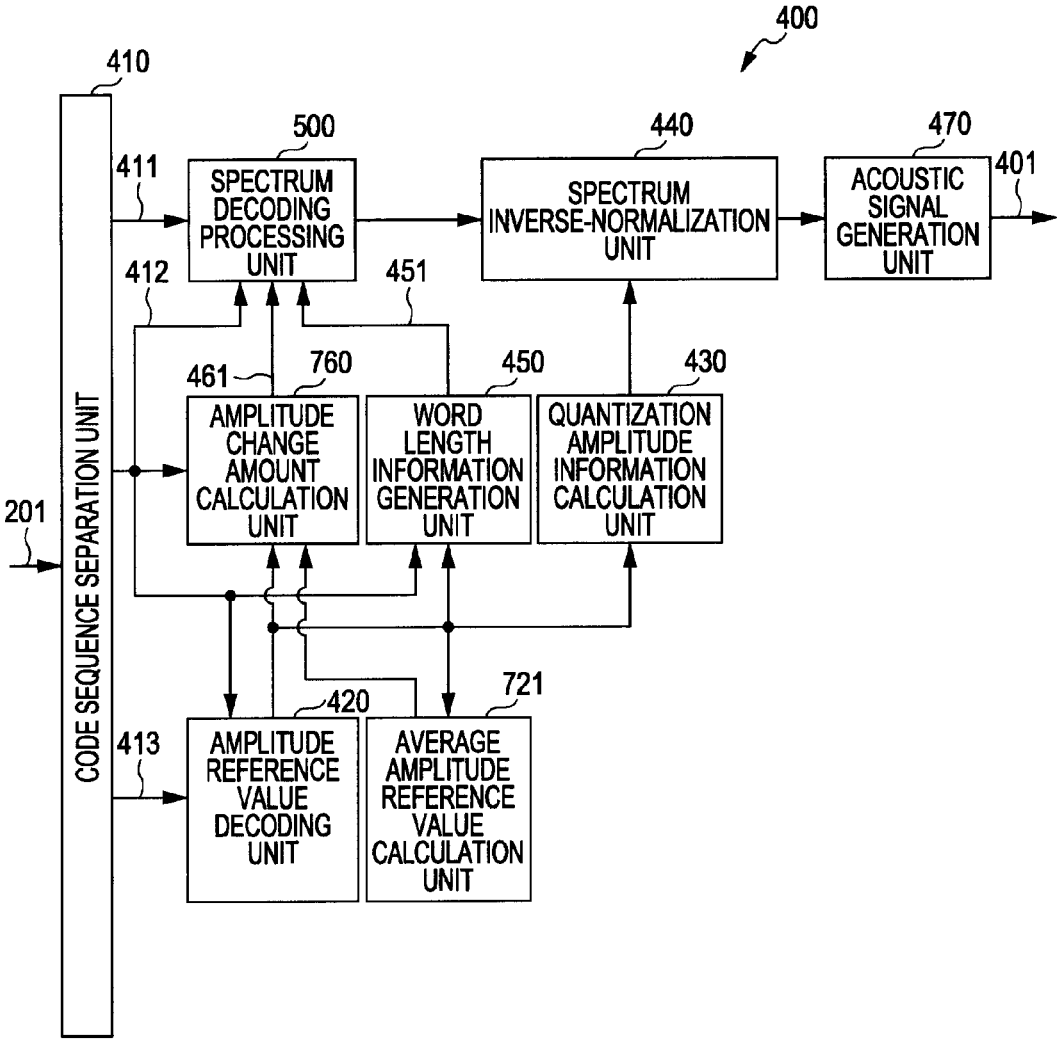
FIG. 21 is a block diagram illustrating an example of a configuration of an acoustic signal decoding apparatus according to a fourth embodiment of the invention.

FIG. 21 is a block diagram illustrating an example of a configuration of an acoustic signal decoding apparatus 400 according to a fourth embodiment of the invention. The acoustic signal decoding apparatus 400 corresponds to the acoustic signal encoding apparatus 200 according to the third embodiment.

The acoustic signal decoding apparatus 400 includes an average amplitude reference value calculation unit 721 and an amplitude change amount calculation unit 760 as a substitute for the amplitude change amount calculation unit 260 in the acoustic signal decoding apparatus 400 illustrated in FIG. 12. Other components except for the average amplitude reference value calculation unit 721 and the amplitude change amount calculation unit 760, which are the same as those illustrated in FIG. 12, are denoted by the same reference numerals as those of FIG. 12, and the description thereof is omitted.

In addition, the average amplitude reference value calculation unit 721 and the amplitude change amount calculation unit 760, which are the same as the average amplitude reference value calculation unit 721 and the amplitude change amount calculation unit 760 in the acoustic signal encoding apparatus 200 illustrated in FIG. 19, are denoted by the same reference numerals as those of FIG. 19, and the description thereof is omitted.

In addition, in the operations of the acoustic signal decoding apparatus 400 according to the fourth embodiment, an amplitude determination process (Step S990) is performed as a substitute for the amplitude determination process (Step S960) in the acoustic signal decoding apparatus 400 illustrated in FIG. 16. Therefore, since other processes except for the amplitude determination process (Step S990) are the same as those illustrated in FIG. 16, the description thereof is omitted. In addition, since the amplitude determination process (Step S990) is the same as that illustrated in FIG. 20, the description thereof is omitted.

In this manner, the average amplitude reference value calculation unit 721 and the amplitude change amount calculation unit 760 are provided, so that it is possible to appropriately decode the acoustic encoding data generated by the acoustic signal encoding apparatus 200 according to the third embodiment. In addition, in the embodiment of the invention, although an example of switching the encoding algorithms by selecting one of the two Huffman encode tables is described, one encoding unit may be selected from a plurality of different encoding units. Now, an example of selecting one of the encoding units is described with reference to the drawings.

5. Fifth Embodiment

[Example of Configuration of Spectrum Encoding Process Unit]

Figure 22:
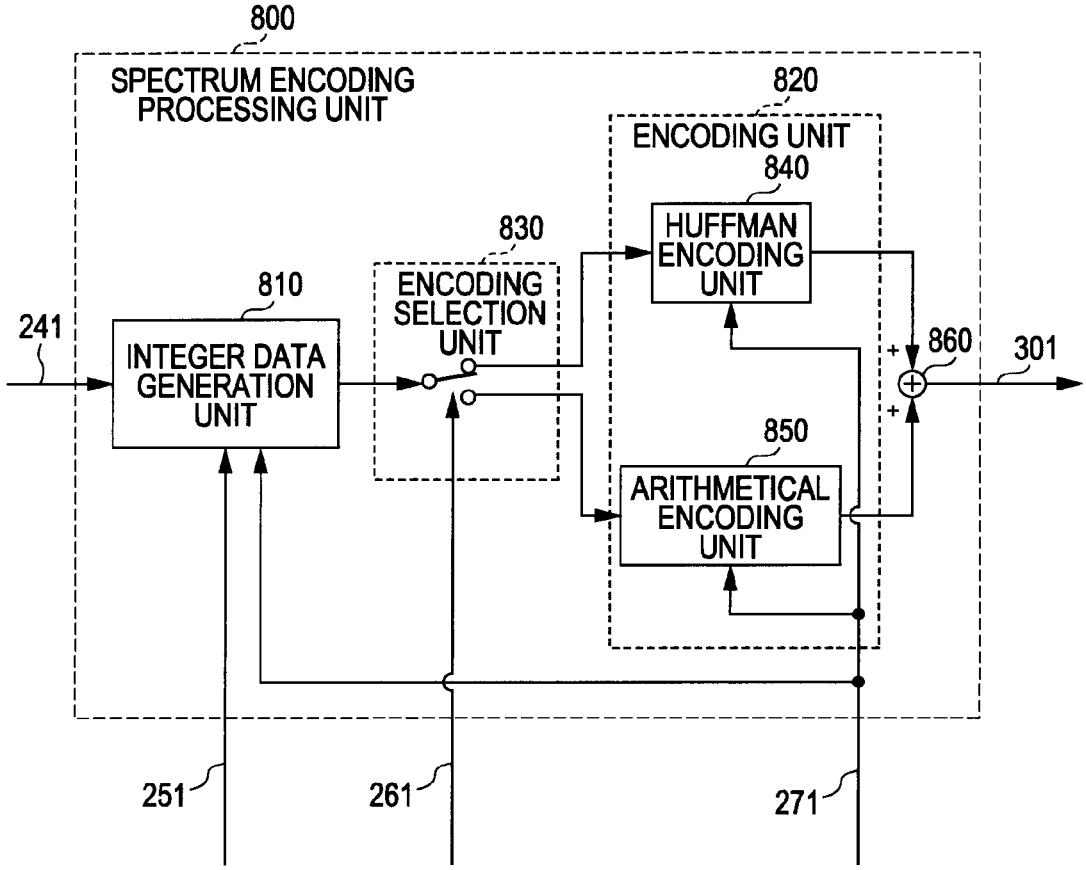
FIG. 22 is a block diagram illustrating an example of a configuration of a spectrum encoding process unit according to a fifth embodiment of the invention.

FIG. 22 is a block diagram illustrating an example of a configuration of a spectrum encoding process unit according to a fifth embodiment of the invention.

The spectrum encoding process unit 800 includes an integer data generation unit 810, an encoding unit 820, an encoding selection unit 830, and an addition unit 860. The spectrum encoding process unit 800 corresponds to the spectrum encoding process unit 300 illustrated in FIG. 2. The encoding unit 820 includes a Huffman encoding unit 840 and an Arithmetic encoding unit 850. In this example, since the integer data generation unit 810 has the same configuration as the integer data generation unit 310 illustrated in FIG. 7, the description thereof is omitted.

The encoding unit 820 encodes the quantization value of the frequency spectrum in the input signal according to the plurality of the encoding algorithms. The encoding unit 820 encodes the integer data, which is a quantization value input from the integer data generation unit 810, by using one of the Huffman encoding unit 840 and the Arithmetic encoding unit 850. In other words, the encoding unit 820 encodes the integer data input from the integer data generation unit 810 according to one of the two encoding algorithms.

In addition, the encoding unit 820 encodes the integer data of the to-be-encoded subband, which is specified by the number of encoding bands input from the signal line 271, in each subband. In addition, the encoding unit 320 outputs the encoded integer data as an encoding data to a signal line 301. In addition, the encoding unit 820 is an example of an encoding unit disclosed in the Claims.

The Huffman encoding unit 840 encodes the integer data, which is output from the encoding selection unit 830, by referring to the encode list previously generated through the Huffman encoding. In the case where the amplitude change determination flag indicates that the amplitude change amount is small, the Huffman encoding unit 840 encodes the integer data corresponding to the amplitude change determination flag. In other words, the Huffman encoding unit 840 encodes the integer data corresponding to the subband where the degree of deflection of the occurrence probability distribution is small. In addition, the Huffman encoding unit 840 supplies the encoded integer data as an encoding data to the addition unit 860.

The Arithmetic encoding unit 850 encodes the integer data output from the encoding selection unit 830 through Arithmetic encoding. In the case where the amplitude change determination flag indicates that the amplitude change amount is large, the Arithmetic encoding unit 850 encodes the integer data corresponding to the amplitude change determination flag through the Arithmetic encoding. In other words, the Arithmetic encoding unit 850 encodes the integer data corresponding to the subband where the degree of deflection of the occurrence probability distribution is large. In addition, the Arithmetic encoding unit 850 supplies the encoded integer data as an encoding data to the addition unit 860.

The encoding selection unit 830 selects one encoding unit of the Huffman encoding unit 840 and the Arithmetic encoding unit 850 based on the amplitude change determination flag supplied through the signal line 261 from the amplitude change amount calculation unit 260. In the case where an amplitude change determination flag indicating that the amplitude change amount of the amplitude reference value is large is supplied, the encoding selection unit 830 outputs the integer data to the Arithmetic encoding unit 850 for encoding the quantization value of which the degree of deflection of the occurrence probability distribution in the subband is large.

On the other hand, in the case where an amplitude change determination flag indicating that the amplitude change amount of the amplitude reference value is small is supplied, the encoding selection unit 830 outputs the integer data to the Huffman encoding unit 840 for encoding the quantization value of which the degree of deflection of the occurrence probability distribution in the subband is small. In other words, the encoding selection unit 830 selects the encoding algorithm according to the degree of deflection of the occurrence probability distribution of the quantization value in the amplitude change amount among the plurality of the encoding algorithms.

More specifically, for example, in the case where the amplitude change determination flag is set to "1", the encoding selection unit 830 outputs the integer data to the Arithmetic encoding unit 850. In addition, in the case where the width change amount determination flag is set to "0", the encoding selection unit 830 outputs the integer data to the Huffman encoding unit 840. In addition, the encoding selection unit 830 is an example of an encoding selection unit disclosed in the Claims.

The addition unit 860 supplies the encoding data output from the Huffman encoding unit 840 or the Arithmetic encoding unit 850 to the signal line 301. In the case where an amplitude change determination flag indicating that the amplitude change amount is large is supplied to the encoding selection unit 830, the addition unit 860 outputs the encoding data, which is supplied from the Arithmetic encoding unit 850, to the signal line 301. On the other hand, in the case where an amplitude change determination flag indicating that the amplitude change amount is small is supplied to the encoding selection unit 830, the addition unit 860 outputs the encoding data, which is supplied from the Huffman encoding unit 840, to the signal line 301.

In this manner, in the fifth embodiment of the invention, the Arithmetic encoding unit 850 is provided, so that it is possible to further improve the encoding efficiency of the integer data corresponding to the subband where the degree of deflection of the occurrence probability distribution of the quantization value is large in comparison with the first and third embodiments.

In this manner, according to the embodiment of the invention, it is possible to improve the encoding efficiency of the quantization value by the encoding process according to the degree of deflection of the occurrence probability distribution in the amplitude change amount of the spectrum envelope with respect to the frequency spectrum of the acoustic signal. In addition, since the algorithm is selected based on the amplitude reference value with respect to each subband, the additional information on the encoding algorithm applied to each subband may not have to be multiplexed to the acoustic encoding data, so that it is possible to reduce the data amount of the acoustic encoding data. Accordingly, it is possible to improve the compression rate by encoding the frequency components of the input signal.

In addition, in the embodiment of the invention, although the acoustic signal processing system 100 for the acoustic signal is described, the invention may be adapted to an image processing system for performing encoding and decoding on an image signal.

In addition, the embodiments of the invention are exemplary ones for embodying the invention. As described in the embodiments of the invention, elements of the embodiments are in correspondence with elements of the invention disclosed in claims. Similarly, the elements of the invention disclosed in claims are in correspondence with the elements of the embodiments of the invention indicated by the same names. However, the invention is not limited to the embodiments, but various modifications may be made to embody the invention within the scope of the invention without departing from the spirit of the invention.

In addition, the procedure of processes described in the embodiment of the invention may be considered a method having a series of the processes or a program for allowing a computer to execute a series of the processes or a recording medium storing the program. As the recording medium, for example, a CD (Compact Disc), an MD (MiniDisc), a DVD (Digital Versatile Disk), a memory card, a Blu-ray Disc (registered trade mark), or the like may be used.

The present application contains subject matter related to that disclosed in Japanese Priority Patent Application JP 2009-168465 filed in the Japan Patent Office on Jul. 17, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal encoding apparatus comprising:

an encoding unit which encodes a quantization value of a frequency spectrum in an input signal through a plurality of encoding algorithms;

an amplitude change amount calculation unit which calculates, for each of a plurality of subbands of the frequency spectrum, an amplitude change amount with respect to the frequency spectrum based on a spectrum envelope of the frequency spectrum; and an encoding selection unit which selects, for each subband, an encoding algorithm according to a degree of deflection of an occurrence probability distribution of the quantization value in the amplitude change amount among the plurality of the encoding algorithms.

2. The signal encoding apparatus according to claim 1, further comprising an amplitude reference value generation unit which generates an amplitude reference value for each subband based on a maximum amplitude level of frequency components in each of the respective subbands, wherein the amplitude change amount calculation unit calculates the amplitude change amount in each subband based on the amplitude reference value with respect to a change amount calculation band that is a predetermined subband among the plurality of the subbands, and wherein, in the case where the amplitude change amount with respect to the subband is large, the encoding selection unit selects the encoding algorithm for encoding the quantization value corresponding to the subband where the degree of deflection is large, in each subband.

3. The signal encoding apparatus according to claim 2, wherein the amplitude change amount calculation unit calculates the amplitude change amount in each subband based on a difference in the amplitude reference value with respect to an adjacent subband that is the change amount calculation band.

4. The signal encoding apparatus according to claim 2, wherein the amplitude change amount calculation unit calculates the amplitude change amount in each subband based on an average value of the amplitude reference values of a set of subbands in a low band and the amplitude reference value with respect to the change amount calculation band.

5. The signal encoding apparatus according to claim 2, wherein the amplitude reference value generation unit generates a scale factor as the amplitude reference value.

6. A signal decoding apparatus comprising:

a decoding unit which decodes encoding data, where a quantization value of a frequency spectrum in an input signal is encoded, through a plurality of decoding algorithms, the frequency spectrum comprising a plurality of subbands;

an amplitude change amount calculation unit which calculates an amplitude change amount with respect to each subband from an amplitude reference value of a predetermined subband among amplitude reference values generated based on frequency components of the subbands; and a decoding selection unit which selects, for each of the subbands, a decoding algorithm according to a degree of deflection of an occurrence probability distribution of the quantization value in the amplitude change amount of each respective subband among the plurality of the decoding algorithms.

7. A signal processing system comprising:

a signal encoding apparatus having:

an encoding unit which encodes a quantization value of a frequency spectrum in an input signal through a plurality of encoding algorithms, the frequency spectrum comprising a plurality of subbands, an amplitude reference value generation unit which generates an amplitude reference value for each subband based on a maximum amplitude level of frequencies in each of the respective subbands, an amplitude change amount calculation unit which calculates an amplitude change amount in each subband based on the amplitude reference value with respect to a change amount calculation band which is a predetermined subband among the plurality of the subbands, and an encoding selection unit which selects, for each subband, an encoding algorithm according to a degree of deflection in an occurrence probability distribution of the quantization value in the amplitude change amount among the plurality of the decoding algorithms; and a signal decoding apparatus having:

a decoding unit which decodes a data, where the quantization value of the frequency spectrum in the input signal is encoded, through a plurality of decoding algorithms, an amplitude change amount calculation unit which calculates the amplitude change amount in each subband based on the amplitude reference value with respect to the change amount calculation band among the amplitude reference values generated by the amplitude reference value encoding unit in the signal encoding apparatus, and a decoding selection unit which, for each of the subbands, selects a decoding algorithm according to the degree of deflection of the occurrence probability distribution of the quantization value in the amplitude change amount of each respective subband among the plurality of the decoding algorithms.

8. A signal encoding process method comprising the steps of:

calculating, for each of a plurality of subbands of a frequency spectrum in an input signal, an amplitude change amount based on a spectrum envelope of the frequency spectrum;

selecting, for each subband, an encoding algorithm according to a degree of deflection of an occurrence probability distribution of a quantization value in the amplitude change amount among the plurality of the encoding algorithms for encoding the quantization value of the frequency spectrum; and encoding the quantization value of the frequency spectrum through the respective encoding algorithms selected for each subband in the step of selecting the encoding algorithm.

9. An non-transitory computer readable storage medium storing a computer program, which when executed by a computer, executes the processes of:

calculating, for each of a plurality of subbands of a frequency spectrum in an input signal, an amplitude change amount based on a spectrum envelope of the frequency spectrum;

selecting, for each subband, an encoding algorithm according to a degree of deflection of an occurrence probability distribution of a quantization value in the amplitude change amount among the plurality of the encoding algorithms for encoding the quantization value of the frequency spectrum; and encoding the quantization value of the frequency spectrum through the respective encoding algorithms selected for each subband in the step of selecting the encoding algorithm.

10. A signal decoding process method comprising the steps of:

calculating an amplitude change amount with respect to a subband from an amplitude reference value of a predetermined subband among amplitude reference values generated based on frequency components extracted in each of a plurality of subbands of a frequency spectrum of an input signal;

selecting, for each subband, a decoding algorithm according to a degree of deflection of an occurrence probability distribution of a quantization value in the amplitude change amount of each respective subband among the plurality of the decoding algorithms for decoding encoding data where the quantization value of the frequency spectrum is encoded; and decoding the encoding data in each subband through the decoding algorithm selected in the step of selecting the decoding algorithm.

11. An non-transitory computer readable storage medium storing a computer program, which when executed by a computer, executes the processes of:

calculating an amplitude change amount with respect to a subband from an amplitude reference value of a predetermined subband among amplitude reference values generated based on frequency components extracted in each of a plurality of subbands of a frequency spectrum of an input signal;

selecting, for each subband, a decoding algorithm according to a degree of deflection of an occurrence probability distribution of a quantization value in the amplitude change amount of each respective subband among the plurality of the decoding algorithms for decoding encoding data where the quantization value of the frequency spectrum is encoded; and decoding the encoding data in each subband through the decoding algorithm selected in the step of selecting the decoding algorithm.

* * * * *